US008794750B2

(12) United States Patent
Gilson et al.

(10) Patent No.: US 8,794,750 B2
(45) Date of Patent: Aug. 5, 2014

(54) INK CONTAINMENT SYSTEM AND INK LEVEL SENSING SYSTEM FOR AN INKJET CARTRIDGE

(71) Applicant: Videojet Technologies Inc., Wood Dale, IL (US)

(72) Inventors: Charles W. Gilson, Philomath, OR (US); Thomas E. Kimerling, Corvallis, OR (US); Mark R. Thackray, Corvallis, OR (US); Kenneth E. Trueba, Corvallis, OR (US); Scott T. Benigni, Chicago, IL (US); John P. Folkers, Palatine, IL (US); Matthew David Beasley, Dallas, OR (US); Terry M. Lambright, Corvallis, OR (US); Kevin Kuester, Freeburg, IL (US)

(73) Assignee: VideoJet Technologies Inc., Wood Dale, IL (US)

( * ) Notice: Subject to any disclaimer, the term of this patent is extended or adjusted under 35 U.S.C. 154(b) by 0 days.

(21) Appl. No.: 13/891,754

(22) Filed: May 10, 2013

(65) Prior Publication Data

US 2013/0314481 A1 Nov. 28, 2013

Related U.S. Application Data

(63) Continuation of application No. 13/491,800, filed on Jun. 8, 2012, now Pat. No. 8,454,146, which is a continuation of application No. 12/541,251, filed on Aug. 14, 2009, now Pat. No. 8,272,704, which is a continuation-in-part of application No. 12/125,126, filed on May 22, 2008, now Pat. No. 8,091,993.

(51) Int. Cl.
*B41J 2/175* (2006.01)

(52) U.S. Cl.
CPC ..... *B41J 2/17503* (2013.01)
USPC ..... 347/87

(58) Field of Classification Search
CPC ..... B41J 2/17556
See application file for complete search history.

(56) References Cited

U.S. PATENT DOCUMENTS

| | | | |
|---|---|---|---|
| 4,119,034 | A | 10/1978 | Wax |
| 4,121,222 | A | 10/1978 | Diebold et al. |
| 4,342,042 | A | 7/1982 | Cruz-Uribe et al. |
| 4,422,084 | A | 12/1983 | Saito |

(Continued)

FOREIGN PATENT DOCUMENTS

EP 2085226 A2 * 8/2009

*Primary Examiner* — Shelby Fidler
(74) *Attorney, Agent, or Firm* — Robert L. Wolter; Beusse Wolter Sanks Mora & Maire, P.A.

(57) ABSTRACT

An ink containment system for an inkjet cartridge, for storing ink for printing, comprises a rigid basin member and a rigid moveable plate. A flexible membrane is affixed to a surface of the basin member and to a surface of the plate forming an ink reservoir within the basin member, plate and flexible membrane. A spring-biased mechanism is disposed between the basin member and plate, for biasing the plate apart from the basin member, generating a negative pressure within the ink reservoir and the basin member remaining stationary relative to the movement of the plate. The basin member has a bowl-like configuration and the spring is seated within the reservoir in such a way that when the ink reservoir has collapsed due to depletion of ink, the flexible membrane and moveable plate are substantially flush with surfaces of the basin member.

10 Claims, 20 Drawing Sheets

(56) References Cited

U.S. PATENT DOCUMENTS

| | | | |
|---|---|---|---|
| 4,500,895 | A | 2/1985 | Buck et al. |
| 4,509,062 | A | 4/1985 | Low et al. |
| 4,524,282 | A | 6/1985 | King |
| 4,604,633 | A | 8/1986 | Kimura et al. |
| 4,935,751 | A | 6/1990 | Hamlin |
| 4,977,413 | A | 12/1990 | Yamanaka et al. |
| 5,068,806 | A | 11/1991 | Gatten |
| 5,136,309 | A | 8/1992 | Iida et al. |
| 5,325,119 | A | 6/1994 | Fong |
| 5,356,312 | A | 10/1994 | Abe et al. |
| 5,359,353 | A | 10/1994 | Hunt et al. |
| 5,414,452 | A | 5/1995 | Accatino et al. |
| 5,426,459 | A | 6/1995 | Kaplinsky |
| 5,440,333 | A | 8/1995 | Sykora et al. |
| 5,450,112 | A | 9/1995 | Scheffelin |
| 5,541,632 | A | 7/1996 | Khodapanah et al. |
| 5,737,002 | A | 4/1998 | Swanson et al. |
| 5,754,207 | A | 5/1998 | Gragg et al. |
| 5,757,390 | A | 5/1998 | Gragg et al. |
| 5,764,259 | A | 6/1998 | Nakajima |
| 5,767,882 | A | 6/1998 | Kaplinsky et al. |
| 5,788,388 | A | 8/1998 | Cowger et al. |
| 5,852,946 | A | 12/1998 | Cowger |
| 5,896,151 | A | 4/1999 | Miyazawa et al. |
| 5,997,121 | A | 12/1999 | Altfather et al. |
| 6,003,986 | A | 12/1999 | Keefe |
| 6,053,607 | A | 4/2000 | Kaplinsky et al. |
| 6,151,039 | A | 11/2000 | Hmelar et al. |
| 6,206,515 | B1 | 3/2001 | Swanson et al. |
| 6,234,603 | B1 | 5/2001 | Altfather et al. |
| 6,364,474 | B1 | 4/2002 | Chang et al. |
| 6,382,764 | B1 | 5/2002 | Shimoda |
| 6,397,745 | B2 | 6/2002 | Koehler |
| 6,412,894 | B1 | 7/2002 | Askren et al. |
| 6,431,673 | B1 | 8/2002 | Heim et al. |
| 6,456,802 | B1 | 9/2002 | Phillips |
| 6,505,924 | B2 | 1/2003 | Shimizu |
| 6,554,382 | B1 | 4/2003 | Sleger |
| 6,676,237 | B2 | 1/2004 | Kobayashi et al. |
| 6,736,497 | B2 | 5/2004 | Jung |
| 6,773,099 | B2 | 8/2004 | Inoue et al. |
| 6,820,955 | B1 | 11/2004 | Usui |
| 6,830,324 | B2 | 12/2004 | Ogura et al. |
| 6,908,180 | B2 | 6/2005 | Dietl |
| 6,969,137 | B2 | 11/2005 | Maeda |
| 7,004,572 | B2 | 2/2006 | Pinard |
| 7,033,007 | B2 | 4/2006 | Seethoo |
| 7,077,514 | B2 | 7/2006 | Inoue et al. |
| 7,104,640 | B2 | 9/2006 | Ogura et al. |
| 2003/0067520 | A1* | 4/2003 | Inoue et al. ..... 347/86 |
| 2004/0080589 | A1 | 4/2004 | Martinez |
| 2004/0090510 | A1* | 5/2004 | Inoue et al. ..... 347/104 |
| 2005/0093939 | A1 | 5/2005 | Takagi |
| 2005/0157030 | A1 | 7/2005 | Silverbrook et al. |
| 2005/0157040 | A1 | 7/2005 | Silverbrook et al. |
| 2005/0168504 | A1 | 8/2005 | Pan et al. |
| 2005/0190226 | A1 | 9/2005 | Yoshikawa et al. |
| 2005/0264624 | A1 | 12/2005 | Ogura et al. |
| 2006/0098063 | A1 | 5/2006 | Suen Lee et al. |
| 2006/0114304 | A1 | 6/2006 | Buchanan et al. |
| 2006/0187268 | A1 | 8/2006 | Olsen et al. |
| 2006/0221153 | A1 | 10/2006 | Kojima et al. |
| 2006/0256174 | A1 | 11/2006 | Kawamura et al. |
| 2007/0013728 | A1 | 1/2007 | Jung |
| 2007/0163671 | A1 | 7/2007 | Boehm et al. |
| 2008/0007601 | A1 | 1/2008 | Tsai et al. |
| 2009/0289972 | A1 | 11/2009 | Lino |
| 2010/0026742 | A1 | 2/2010 | Morino |

* cited by examiner

INK CONTAINMENT SYSTEM AND INK LEVEL SENSING SYSTEM FOR AN INKJET CARTRIDGE

CROSS-REFERENCE TO RELATED APPLICATIONS

This application is a Continuation of U.S. application Ser. No. 13/491,800 filed Jun. 8, 2012, which is a Continuation of U.S. application Ser. No. 12/541,251 filed Aug. 14, 2009, now issued as U.S. Pat. No. 8,272,704 on Sep. 25, 2012, which is a Continuation-In-Part of U.S. application Ser. No. 12/125,126 filed May 22, 2008, now issued as U.S. Pat. No. 8,091,993 on Jan. 10, 2012, and claims priority to PCT/US2009/044974 filed May 22, 2009, and incorporated herein by reference in their entirety.

BACKGROUND OF THE INVENTION

An embodiment of the invention pertains to inkjet printers and inkjet cartridges. More specifically, an embodiment of the invention relates to ink containment systems or ink reservoirs used to store ink in an inkjet cartridge.

Typically, an inkjet cartridge comprises an outer housing within which an ink containment system or ink reservoir is disposed in fluid communication with an inkjet printhead. A mechanism linked to the ink reservoir generates a negative pressure or backpressure that is maintained within a sufficient range to prevent ink from leaking from the printhead, but also allow injection of ink for printing.

Controlling the internal pressure within the ink reservoir has been the subject of patents for more that twenty years. Earlier now expired patents including U.S. Pat. No. 4,422,084 (the '084 patent); U.S. Pat. No. 4,509,062 (the '062 patent); and, U.S. Pat. No. 4,500,895 (the '895 patent) disclose a variety of mechanisms used to generate and control a negative pressure in an ink reservoir. The '084 and '895 patents disclose pouch, bag or bladder-like configurations that rely on the elasticity of the materials composing the reservoirs to generate the negative pressure. The '084 patent also discloses using a biasing means disposed within the ink reservoir to urge walls of the reservoir apart from one another, or moving one wall apart from another fixed wall.

To that end, the '084 patent discloses an ink containment system that incorporates a single flexible membrane secured within a cartridge housing and forming an ink reservoir with the walls of the cartridge. A spring is not disposed within the reservoir, but outside the reservoir and biases the flexible membrane away from the cartridge walls to generate a negative pressure in the ink reservoir. A similar such design is disclosed in the '062 patent.

In later issued patents there is disclosed cartridges that have two moveable sidewalls that form the ink reservoir and a biasing means disposed between the sidewalls to create negative pressure. For example in U.S. Pat. No. 5,325,119 (the '119 patent); U.S. Pat. No. 5,440,333 (the '333 patent); U.S. Pat. No. 5,737,002 (the '002 patent); U.S. Pat. Nos. 5,767,882; and, 6,053,607, there is disclosed inkjet cartridges having two flexible sidewalls secured to an internal frame structure to form an ink reservoir. Each of the moveable sidewalls comprises a plate member covered by a flexible membrane. The peripheral edge of each membrane is secured to an internal frame structure attached to the walls of the cartridge housing thereby forming the ink reservoir or ink bag. A pressure regulator is disposed within the ink bag and includes two side plates and a spring disposed between the plates biasing the two plates apart from one another and toward the membranes. The spring disclosed in most of these patents is a bow or leaf spring; however, the '119 patent shows an embodiment with a helical spring. As ink is ejected from the cartridge the reservoir collapses including both sidewalls moving toward one another. The spring biases the sidewalk apart to generate the negative pressure.

A drawback in this design is that the plates, especially metal plates, the flexible membrane may have a tendency to tear at the points or lines of engagement of the membrane against edges of the plate. The '333 patent offers a way of preventing the tearing the membranes by securing a protective cover layer between the plate and the membrane. The membrane is heat bonded to the cover layer in a centrally located rectangular area of the side membrane, cover layer and plate. However, such a system adds additional steps to the manufacturing process that may be avoided using different materials that may be more compatible with one another. The '333 patent offers an alternative embodiment in which the membrane is bonded directly to the plate in the absence of the cover layer, which embodiment may still expose the membrane to the edges of the plates; however, this embodiment is not linked to the bonding means as claimed.

In these above cited patents, and other patents owned by the same assignee, Hewlett Packard, methods and materials are disclosed for manufacturing inkjet cartridges For example, in the '002 patent there is disclosed an inkjet cartridge having an ink bag design similar to that disclosed in the '333 patent. The '002 patent is directed to materials used to fabricate components of the inkjet cartridge. More specifically, the inkjet cartridge includes an external frame member having an internal frame member mounted thereon for attachment of the ink bag. The external frame member is composed of a first plastic material and the internal frame member is composed of a second plastic material. An ink bag in the cartridge includes two membranes each of which is composed of a third plastic material. The second plastic material and third plastic material are compatible with another so the membranes may be bonded to the internal frame member to form the ink bag.

In addition, the external and internal frame members are fabricated using what is known as a "two-shot" molding process. The external frame member is formed using an injection molding process, which is the "first shot", which is then inserted into a second mold for where the second plastic material is molded to the external frame member to form the internal frame member.

In the above referenced patents assigned to Hewlett Packard, and the U.S. Pat. No. 6,206,515 (the '515 patent), a printhead is mounted onto a snout portion of the cartridge. The snout is incorporated as an integral component of the external frame member as compared to fabricating the snout as a component separate from the external frame and mounting the snout to the frame member.

In U.S. Pat. No. 5,450,112 (the '112 patent) there is disclosed an ink bag for an inkjet cartridge that includes two flexible membranes bonded to an internal frame member to form the ink bag. Requirements for materials composing the membrane include flexibility, gas/moisture barrier, chemical resistance, mechanical toughness, heat sealability and cost. A laminate structure is disclosed to apparently meet these requirements. The membranes include a laminate structure including two laminated layers adhered to one another. Each laminated layer includes a carrier layer, a barrier layer affixed on a first surface of the carrier layer and a sealant layer affixed to a second surface of the carrier layer. The barrier layers for each of the laminated layers are affixed to one another by an adhesive form the laminated structure. The barrier layer disclosed is an aluminum film on a surface of the carrier layer.

Sidewalls including a flexible membrane and plate members are also disclosed in U.S. Pat. No. 6,773,099 (the '099 patent); U.S. Pat. No. 6,830,324 (the '324 patent); U.S. Pat. No. 7,004,572 (the '572 patent); U.S. Pat. No. 7,077,514 (the '514 patent); and, U.S. Pat. No. 7,104,640 (the '640 patent). In each case there is disclosed a single moveable member secured against walls of a cartridge housing forming an ink reservoir. The moveable member includes a preformed flexible membrane for receiving a plate member. A spring is disposed in the ink reservoir between the housing and plate member biasing the moveable member away from the housing wall to create a negative pressure. In other embodiments, the spring is disposed with the cartridge housing between the moveable member and a wall of the cartridge outside of the ink reservoir. As ink is depleted from the ink reservoir, the moveable member collapses along a periphery of the plate. As noted above, the flexible membrane is preformed having a centrally located area on the membrane for receiving the plate, which may create additional steps and costs in the manufacture of the cartridge.

Additional components have been provided to inkjet cartridges, in addition to the above-described mechanism for generating and controlling a constant negative pressure in an ink reservoir. In the '099, '572, '514 and '640 patents, a one-way valve is placed in fluid communication with the ink reservoir. A flexible membrane and plate member open and close openings in the valve in response to changes in pressure within the ink reservoir. If the pressure exceeds a limit, the one-way valve opens to introduce ambient air into the reservoir to decrease the negative pressure so that ink may be effectively ejected from the printhead.

In addition, pressure chambers disposed outside of the ink reservoir have been utilized in lieu of, or in addition to biasing means disposed within the ink reservoir for maintaining a constant negative pressure in an ink reservoir. In U.S. Pat. No. 5,764,259 there is disclosed an inkjet cartridge having negative pressure regulating chamber disposed within the cartridge to maintain a constant negative pressure in the ink reservoir. A bellows-type contracting and expanding wall is attached to a cartridge wall and a regulating plate. The ink reservoir constitutes the remaining interior of the cartridge outside the pressure regulating chamber. In addition, the chamber is in fluid communication with the atmosphere via an aperture in the cartridge wall.

When ink fills the reservoir, the plate and wall constrict in a retracted position. As ink empties from reservoir during printing operations, wall expands against the resistance from the wall creating the negative pressure in the reservoir. When the wall of the pressure regulating chamber reaches a maximum expansion, air is introduced into the chamber in the form of air bubbles through an aperture in the cartridge wall outside the pressure chamber an in the ink reservoir. The negative pressure is maintained within a predetermined range by the capillary force at the aperture.

U.S. Pat. No. 7,033,007 discloses a pump mechanism that presses against the bias of a spring in an ink chamber pressurizes the chamber at a suitable pressure for drawing ink from the chamber. When the chamber is depleted of ink, the pumping mechanism is released and the spring biases the chamber in a direction to draw ink from a reserve ink supply. However, such valves and pumping mechanism increase the complexity, cost and repair of the cartridges.

In published applications U.S. Publication Nos. 2005/0157040 A1 and 2005/0157030 A1 there is disclosed an inkjet cartridge that includes a collapsible reservoir including an annular flexible membrane (bag) secured at each end to plates. One plate is fixed and the other plate slides within a frame having struts as the bag collapses from depletion of ink or expands as it is filled with ink. Negative pressure is created by a spring attached to the moveable plate and the frame outside of the ink reservoir.

A published application, U.S. Publication No. 2006/0221153 A1, discloses a stress dampening unit disposed between a collapsible ink cartridge and the wall of the cartridge housing. The stress dampening unit includes a flexible cylindrical membrane attached to the flexible membrane of the ink reservoir. A compression spring is disposed within the ink reservoir. In addition, a second compression spring may be disposed in the dampening unit. An orifice in the wall of the cartridge at the dampening unit provides fluid communication between the dampening unit and atmospheric air. As the ink reservoir collapses as a result of an impact, such as may occur if the ink reservoir is dropped or hit against a desk, the dampening unit may minimize the collapse of the ink reservoir. In addition, the dampening unit may be used to control the increase of negative pressure in the ink reservoir.

Systems that utilize springs and flexible membranes are not limited to positioning the spring within the ink reservoir. Some cartridges have mechanisms disposed outside of the ink reservoir, attached to a collapsible wall and pulling on the wall to generate the negative pressure, as compared to systems that have an internally mounted spring, which systems push a moveable wall away from another wall forming the reservoir. A spring mounted external of the ink reservoir is shown U.S. Pat. No. 6,505,924, which discloses cantilevered spring plates mounted externally relative to the ink reservoir. An externally mounted cantilevered spring is also shown in U.S. Pat. No. 6,908,180.

Some cartridges utilize bag-like or bladder-like pouches to form a collapsible reservoir. Examples of such ink reservoirs may be seen in U.S. Pat. No. 6,736,497; 6,412,894 (FIG. 5); U.S. Pat. No. 6,364,474; and U.S. Publication No. 2006/0098063 A1.

Some systems or devices used to generate negative pressure in an ink reservoir include a porous material such as a sponge or foam core disposed within the cartridge housing. In such cases, the walls of the housing define the ink reservoir which is connected to a printhead, and the absorption of the ink in the sponge acts to generate the negative pressure.

Inkjet cartridges typically incorporate systems, devices or methods for detecting an ink level in a cartridge or ink reservoir. Inkjet cartridges have a minimum level or volume of ink at which the inkjet cartridge may effectively operate. If the volume of ink drops below the minimum level the cartridge risks blank ejections, which may damage the printhead. Prior patents disclose various ink level sensing techniques, including systems employing optical sensing devices, systems that test the electrical conductivity or transparency of the ink to determine an ink level and systems that require visual inspection of components to determine an ink volume remaining in the cartridge.

In those patents disclosing optical sensors, a part is connected to a flexible membrane of a collapsible ink reservoir. The devices are configured so that once the flexible membrane collapses to a predetermined level or position in the ink reservoir the sensor is activated. U.S. Pat. No. 4,342,042 discloses a reflective dot on the membrane and detector including a light emitting diode and photo-transistor. As the reflective dot moves up and down with the change in the ink volume, the photo-transistor detects more or less reflected light.

U.S. Pat. No. 4,604,633 discloses an ink level detecting system that includes light shielding plate connected to a flexible membrane and moves up and down with movement of the membrane as ink is emptied from or injected into the ink reservoir. The shielding plate is disposed between a light emitting element and a light receiving element. The movement of the flexible membrane causes movement of the light shielding plate, which is detected by the light emitting and light receiving elements to indicate a remaining volume of ink in the ink reservoir.

U.S. Pat. No. 5,757,390 discloses an ink level sensing system and method for sensing an ink level that includes the use of a cartridge having two slots, each slot is positioned on opposing wails and aligned to form a light beam path. A light source is mounted on a carriage to generate a light beam, and a detector is mounted on the carriage to generate a signal if it detects light from the light beam. As the cartridge moves on the carriage through the light beam, the ink level may interrupt the beam for detecting a level of remaining ink. The amount of ink is determined by comparing the position of the ink level and the position of the cartridge on the carriage.

U.S. Pat. No. 5,997,121 is directed to an ink level and cartridge detection system that includes two light reflectors formed as an integral part of the cartridge wall. The reflectors are used in conjunction with a two light sources and a photosensor. One light source is a roof mirror that reflects light when the cartridge is positioned on the carriage. The second reflector is a faceted prism used to reflect light to determine an ink level of the cartridge. A similar such ink level and cartridge detection system is disclosed in the U.S. Pat. No. 6,234,603.

The system for detecting an ink supply disclosed in U.S. Pat. No. 5,844,579 is directed to cartridge that has a pump to force ink from a reservoir. An actuator drives the pump. A sensor associated with the pump detects when the actuator is in a position that represents the ink in the reservoir is depleted.

As mentioned above, some ink level detecting systems utilize the electrical conductivity of the ink as component of an ink level sensing system. The sensing system disclosed in U.S. Pat. No. 4,977,413 is directed to an ink remain detector that is disposed in a fluid path from an ink tank to a recording head. The detector includes a pair of electrodes connected to a first alarm and a pair of electrodes connected to a second alarm. Both pairs of electrodes are fixed within an interior of the cartridge; and, conductive plates move responsive to movement of the flexible membrane between the pairs of electrodes to determine a remaining ink volume. Alarms connected to the electrodes sound when the connector plates come in contact with the electrodes.

In U.S. Pat. No. 6,554,382 there is disclosed an ink level sensing system in an inkjet cartridge that includes a first and second resistance probe mounted in respective ports that protrude from a bottom of a cartridge. The ports and probes are in fluid communication with an ink reservoir. When the reservoir and ports are filled with ink, the resistance across the probes is high. When ink is drawn from the reservoir and one or both of the probes, the resistance is low indicating that the ink level is low.

A patent that discloses an ink level sensing device that includes a visual inspection by an operator is U.S. Pat. No. 4,935,751 (the '751 patent). The '751 patent discloses a rigid plate attached to one side of a collapsible bag. The cartridge has a window on an end of the cartridge housing. As the ink bag collapses, an end of the plate comes into view within the window. The position of the plate relative to the window indicates a remaining ink volume. The window may also include indicia representing a volume measurement of ink.

Still other patents that use a visual indicator incorporate indocile strips outside the cartridge that move responsive to movement of a collapsible reservoir. One such example is found in U.S. Pat. No. 5,359,353. The strip is attached to a flexible ink bag. As the flexible bag deflates with exhaustion of ink, an indicia on the strip moves in or out of view through a window which is on second strip that overlaps the indicia strip. U.S. Pat. No. 6,736,497 discloses an ink level sensing system that uses a flexible strip attached to a collapsible reservoir bag. Portions of the strip extend outside of the cartridge and are covered by panels with a window. As the bag collapses the strip portions move past the window showing indicia indicative of a remaining ink volume.

Some inkjet cartridges incorporate a technology known as "ink drop counting." A controller is placed in communication with a printhead on the cartridge and counts the number of ink drops that are ejected from the printhead. Generally, the controller includes a database and/or look up table that includes data relative to one or more ink volumes that are associated with an ink drop count to determine a remaining ink volume. Some ink level systems may use ink drop counting in combination with other detection systems to more accurately determine an ink volume. Others may factor in printhead characteristics such as nozzle temperature to determine an ink drop size and volume. Still others may compare the ink drop data taken over multiple ranges to calculate a remaining ink volume.

In U.S. Pat. No. 4,121,222 there is disclosed a drop counter ink replenishing system for an inkjet printer that discloses a main ink tank and a supply ink tank. The system also includes an ink drop counter that counts the ink drops expelled from a printhead. When the ink drop count reaches a predetermined number, a flow control means is actuated and ink from the supply tank is supplied to the main ink tank. Similarly, U.S. Pat. No. 5,068,806 discloses a system that counts ink drops to determine an ink level within an inkjet cartridge. In the '806 patent, the disclosed system is used with disposable cartridges such that when the ink drop count reaches a predetermined number the cartridge is disposed of and replaced.

U.S. Pat. No. 6,151,039 (the '039 patent) is directed to an inkjet printing system and method of determining an amount of ink in an ink container that incorporates ink drop counting and sensors that detect remaining ink volume and provide an accurate estimate of ink remaining in a cartridge. An information storage device estimates a volume of ink over a first volumetric range using ink drop count data. The device or method also utilizes a sensing circuit that detects an ink level at a predetermined volume. This sensed volume is used to estimate the ink volume over a second volume range that is different than the first range. The sensed volume is combined with count drop data over the second volumetric range to estimate the remaining ink volume.

In U.S. Pat. No. 6,676,237 there is disclosed a method for correcting calculations of ink amount consumed in a cartridge. The method uses ink drop counting to calculate an amount of ink consumed. A sensor/monitor monitors an ink level to generate a signal when the ink levels falls to a predetermined value. The data from this monitoring is used to correct a residual ink count determined by the ink drop count.

A method and apparatus for detecting a remaining ink in an inkjet cartridge using a sensor/detector and ink drop counting is disclosed in U.S. Pat. No. 6,969,137. The cartridge includes a sensor to detect ink level at a predetermined threshold. If ink drop counting calculates that the volume of ink exceeds the predetermined threshold a correction is made by adding the predetermined amount to the amount remaining as determined by the ink drop count.

Ink level sensing systems may factor in characteristics of or events happening at the inkjet printhead. With respect to U.S. Pat. No. 5,414,452 there is disclosed an ink jet cartridge and ink level sensing system that provides a correction in determining the volume of ink remaining in an ink reservoir. More specifically, the system estimates the volume of ink that evaporates over a predetermined time period and then adds that number to the ink drop count. U.S. Pat. No. 6,820,955 discloses an inkjet printing system that controls ink level in a cartridge by factoring the temperature at the printhead.

With respect to U.S. Pat. No. 6,431,673 there is disclosed a method of determining a volume of ink remaining in an ink jet cartridge by associating the drop count with the weight of the ink expelled. Drop weight estimates are made during intervals using temperature and printing frequency data for each interval. U.S. Pat. No. 6,382,764 discloses a printing method and apparatus for ink drop counting that factor in ink drops that are accumulated in a recovery suction operation.

In addition, inkjet cartridges may also be equipped with memory devices that store data relative to an ink drop count, or remaining volume of ink in an ink reservoir. U.S. Pat. No. 5,788,388 is for an inkjet cartridge with ink level detection means. A chip on the cartridge stores ink depletion data. When the ink level reaches a predetermined threshold a sensor sends a signal to the chip which generates an ink depletion signal. The Chip can be reset if the cartridge is filled.

Although not directed to an inkjet cartridge, but to an ink reservoir, U.S. Pat. No. 5,365,312 discloses to an ink reservoir that has thereon an electronic memory means that contains data relative to a fill status of the reservoir. In addition, the memory may contain a counter for determining an expiration of the reservoir.

Still other ink level sensing systems may factor in the movement or position of an inkjet cartridge on a carriage to determine an ink volume. For example, U.S. Pat. No. 5,136,309 is directed to a residual ink quantity detecting means that includes a detection device that detects when ink in an ink supply is low and generates a responsive signal. This first signal is received by a signal output means, which generates a second signal when the pulse width is greater than a predetermined pulse width, and generates a signal indicative of low ink. The printer includes electronic circuitry that enables the signal output means to alter the first detection signal during certain printer operations, such as when the cartridge is making a left or right carriage turn, when the detection device may erroneously generate a signal indicative of a low ink supply due to movement of ink in the ink reservoir.

BRIEF DESCRIPTION OF THE INVENTION

An ink containment system for an inkjet cartridge, for storing ink for printing, comprises a housing having a plurality of walls. A rigid basin member and a rigid moveable plate are disposed within the housing and the basin member. A flexible membrane is affixed to a surface of the basin member and to a surface of the plate forming an ink reservoir within the basin member, plate and flexible membrane. A spring-biased mechanism is disposed between the basin member and plate, for biasing the plate apart from the basin member, generating a negative pressure within the ink reservoir and the basin member remains stationary relative to the movement of the plate.

In one embodiment the flexible membrane may have an annular configuration with a first peripheral edge affixed to a surface of the plate and a second peripheral edge affixed to a surface of the basin member. The plate may have an annular groove formed therein for receiving a first end of the spring-biased mechanism. A raised portion may be disposed within the housing and ink reservoir over which a second end of the spring biased mechanism is seated. In another embodiment, the raised portion may be disposed on a section of the basin member. In an embodiment, the basin member may have a bowl-like configuration comprising a rim, a mid-section or floor displaced relative to the rim and an annular sloping wall integral to the rim and mid-section. In addition, the basin may have an annular groove in which a second end of the spring is seated so that when the ink reservoir collapses from depletion of ink, the grooves in the moveable plate and the basin have a depth dimension equal to a height of the compressed spring, and the moveable plate is substantially flush with the midsection of the basin. In an embodiment, the moveable plate may have a recess for receiving the raised portion when the ink reservoir is collapsed. Moreover, the flexible membrane may conform to the contour of the wall of the basin, and the flexible membrane is substantially flush with a surface of the basin so as much ink as possible may be discharged from the reservoir.

The cartridge may also have a standpipe in a snout that is mounted to the cartridge housing, and/or basin member; and, the standpipe may have a longitudinal axis that is disposed at an acute angle relative to the printhead. The standpipe may include a first standpipe opening adjacent an opening of the ink reservoir and a second opening adjacent to the printhead. The first opening has a width dimension that is larger than the width dimension of the second opening; and, both openings have a substantially equal height dimension. Such a tapered configuration and orientation of the standpipe relative to the printhead allows gas bubbles at the printhead to travel toward the first opening of the standpipe. The above-described tapered configuration promotes movement of gas bubbles toward the first opening in either a horizontal or vertical printing position.

Another embodiment of the invention may also have an ink level sensing system for detecting when an ink level has reached a predetermined volume remaining in the ink reservoir. A sensor is provided to detect a detection flag that is connected to the plate at a position in the housing that is indicative of a predetermined volume of ink remaining in the ink reservoir. The detection flag is disposed relative to the plate and in the housing having a longitudinal axis that is disposed at an angle of about 45° to a horizontal axis and vertical axis of the cartridge when the printhead is in a horizontal or vertical printing position.

In a further embodiment, after the sensor detects the presence of the detection flag a signal is transmitted to a controller which is programmed to count the ink drops ejected during printer operations. Data representative of a total number of ink drops associated with the predetermined remaining volume of ink is stored in the system. After the total number of ink drops is counted as being used, a signal is generated indicating that the ink reservoir is empty of ink.

In another embodiment the ink level sensing system comprises a light emitting diode (LED) that transmits a light beam to a center of the moveable plate, and a position sensitive detector or device (PSD) that detects light reflected off the moveable plate. As the ink reservoir collapses and the plate moves away from the LED, the position at which the reflected light impacts the PSD changes. The PSD transmits a signal indicative of the position of the plate in the cartridge, which represents a volume of ink remaining in the ink reservoir. In an embodiment, the cartridge can print in a horizontal or vertical printing position with the cartridge or ink reservoir having been rotated 180° about an axis of symmetry. The LED transmits light onto the center of the moveable plate, which does not necessarily change in the horizontal or vertical printing position, providing consistent ink level detection in both printing positions.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Figure 1:
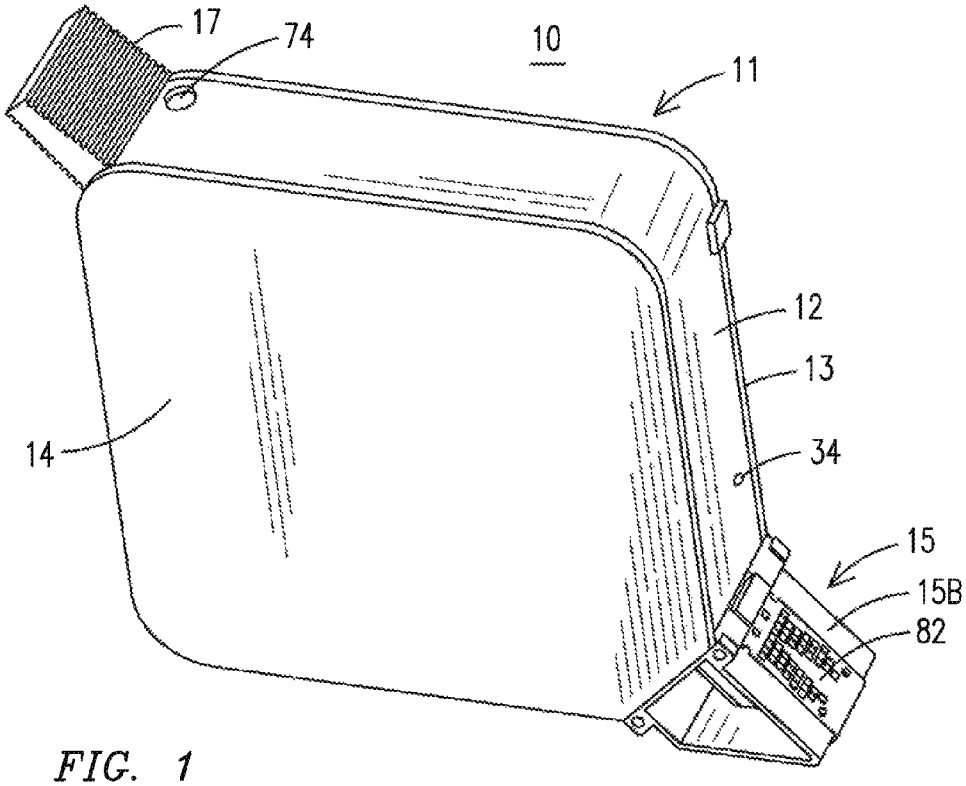
FIG. 1 is a first perspective view of an inkjet cartridge with printhead and sensor.

Reference will now be made in detail to the embodiments consistent with the invention, examples of which are illustrated in the accompanying drawings. Wherever possible, the same reference numerals are used throughout the drawings and refer to the same or like parts.

Figure 2:
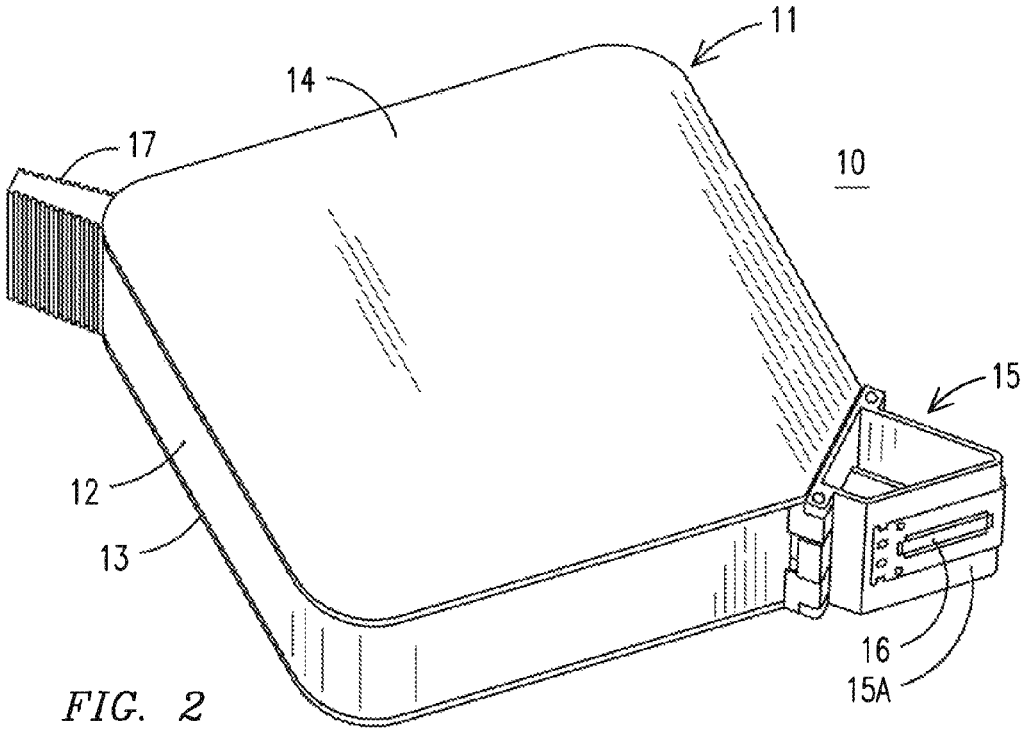
FIG. 2 is a second perspective view of an inkjet cartridge with a printhead and aperture to an internal fill port.

An inkjet cartridge 10 shown in FIGS. 1 and 2 may be mounted on a moveable or stationary carrier for printing and has a printhead 16 in fluid communication with an ink reservoir 19 encased within housing 11. Responsive to printing commands from a controller (not shown), the printhead 16 discharges ink from the ink reservoir 19 onto a print medium (not shown). The housing 11 comprises a sidewall 12, a first cover plate 13 and a second cover plate 14. For purposes of assembling the cartridge 10, either the first cover plate 13 or second cover plate 14 may be integrally formed with the sidewall 12. The other cover plate 13 or 14 is then affixed to the sidewall 12 encasing an ink reservoir 19 within housing 11. Alternatively, both cover plates 13 and 14 may be fabricated as components separate and apart from the sidewall 12, and then affixed to the sidewall 12.

A snout 15, attached to the housing 11, includes the printhead 16 mounted thereon and nozzles (not shown) in fluid communication with the ink reservoir 19 to eject ink from the cartridge per printing commands. As explained in more detail below, the snout 15 is attached to the housing 11 as a separate component and is not integrally formed with the sidewall 12 as disclosed in U.S. Pat. No. 6,206,515 (the '515 patent), which describes a snout as an integral component of an external frame member. The external frame member is a component of an outer casing of the inkjet cartridge disclosed in the '515 patent.

As shown in FIG. 1, an aperture 34 is formed in the housing 11 and aligned with a fill port 33 of the ink reservoir 19, which are described below in more detail. In addition, a sensor 18 is mounted in the housing 11 for use in an ink level sensing system incorporated in the cartridge 10. A handle 17 is disposed on the sidewall 12 of the housing 11 opposite the snout 15. In the embodiment disclosed herein the sidewall 12 is generally rectilinear with the snout 15 and handle 17 disposed on opposite corners of the housing 11.

Figure 3A:
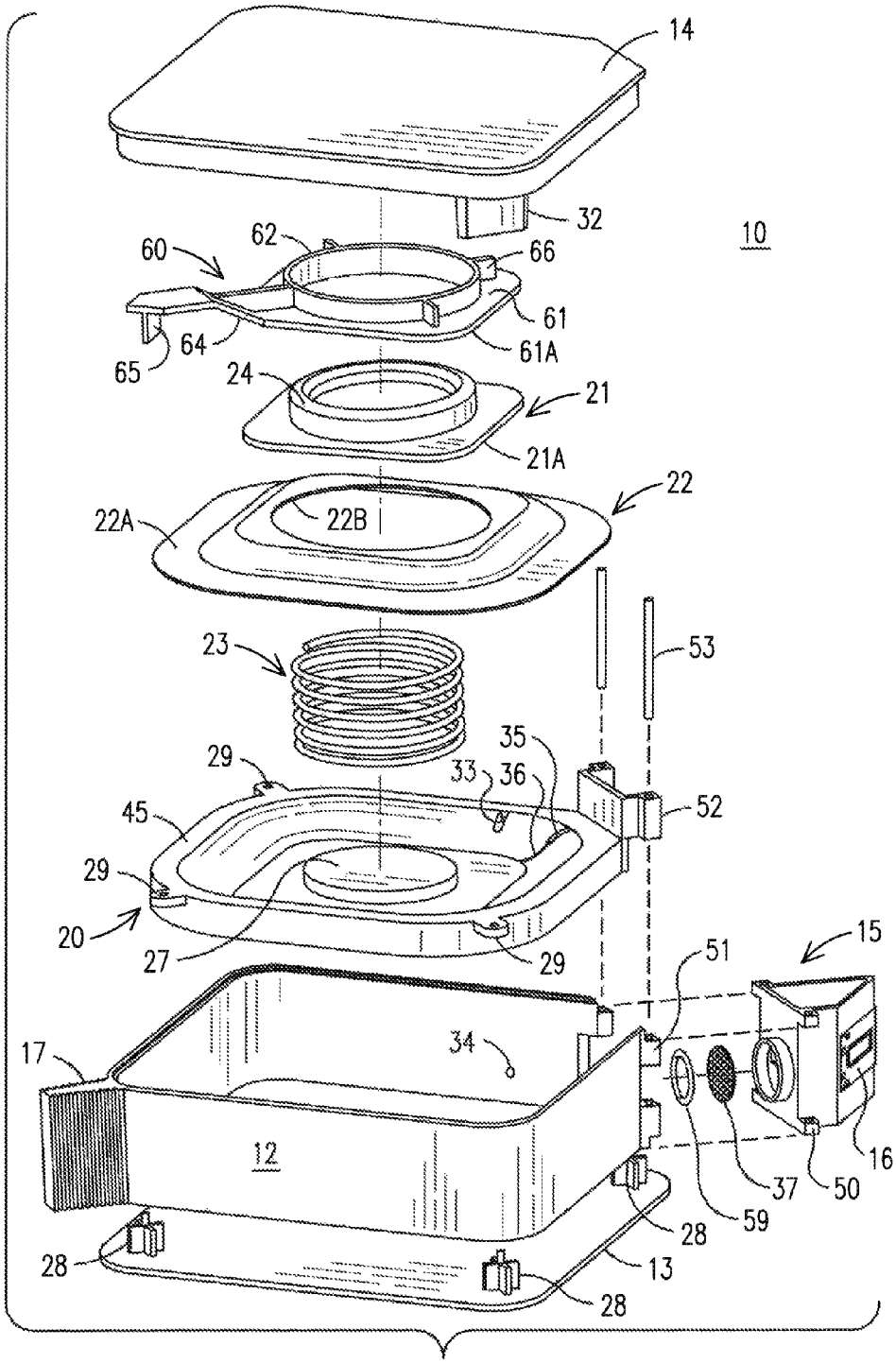
FIG. 3A is an exploded view of a first embodiment the inkjet cartridge and internal components.
Figure 4A:
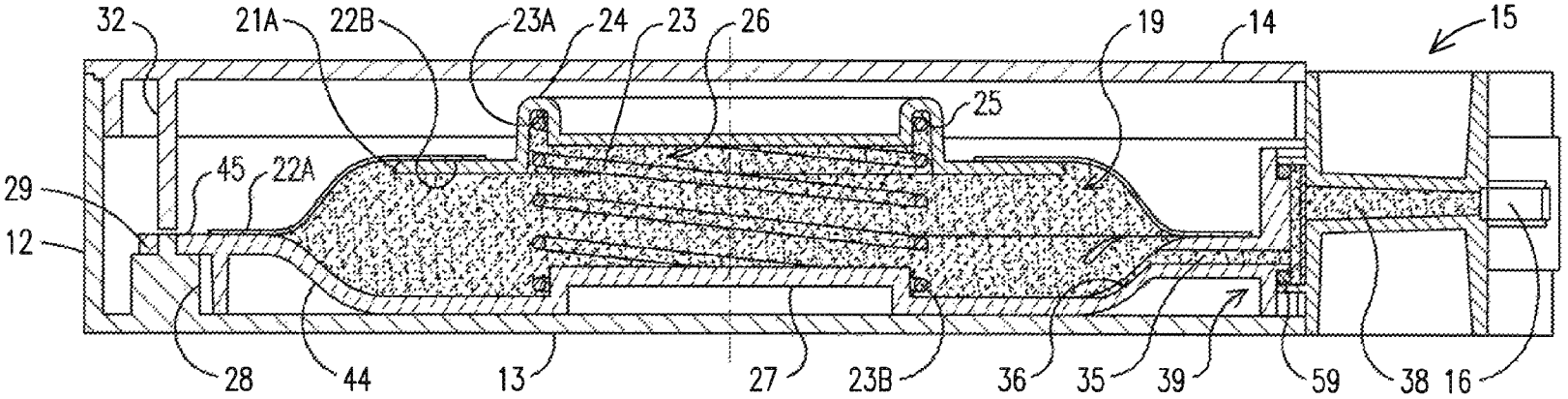
FIG. 4A is a sectional view of the inkjet cartridge with an ink reservoir in an expanded position.
Figure 4B:
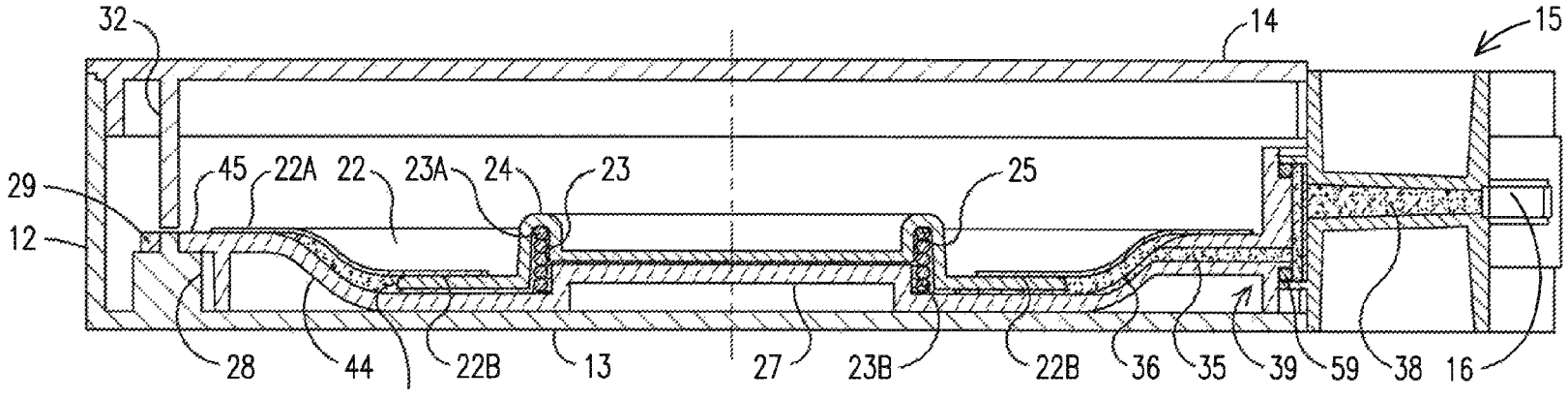
FIG. 4B is a sectional view of the inkjet cartridge with an ink reservoir in a collapsed position.

The ink reservoir 19 and the components making up the ink reservoir 19 are described in more detail with respect to FIGS. 3A, 4A and 4B. The ink reservoir 19 is generally defined by a rigid basin member 20, a rigid moveable plate 21 and a flexible membrane 22 that is affixed to both the basin membrane 20 and the moveable plate 21. A spring 23 is disposed between the basin member 20 and the plate 21, and biases the plate 21 away from the basin member 20 to generate a negative or back pressure in the ink reservoir 19 to prevent ink from drooling from the nozzles on the printhead 16. As ink is ejected during printing and other operations, the flexible membrane 22 collapses towards the basin member 20, thereby causing the plate 21 to move towards the basin member 20. The spring 23 biasing force against the plate 21 generates the negative pressure in the ink reservoir 19.

As described above, only the plate 21 is moveable as the basin member 20 remains fixed within the housing 11. In addition, the reservoir 19 includes only a single flexible membrane 22, which is distinguishable from those patents in the '119 patent; U.S. Pat. No. 5,440,333 (the '333 patent); the '002 patent; 5,767,882; and, U.S. Pat. No. 6,053,607 that disclose the use of two flexible membrane sheets that have peripheral edges secured to an internal frame member. The flexible membranes disclosed in these patents are rectangular sheets and each covers a respective moveable side plate with the peripheral edges of the flexible membranes sealed to the internal frame member, so the moveable side plates are disposed within an ink reservoir. The internal frame member is affixed to an external frame member, which is described as a rectilinear member and does not include cover plates of the cartridge. In these prior art references, a spring is disposed between the side plates and biases the plates apart from one another; whereby, both plates move relative to one another to generate a negative pressure in an ink reservoir.

In contrast, in embodiments of the invention disclosed herein, the plate 21 moves relative to the stationary basin 20, which is secured against the first cover plate 13. The flexible membrane 22 may have the annular configuration shown in FIG. 3A, having a first peripheral edge 22A sealed against the basin member 20 and a second peripheral edge 22B sealed against the moveable plate 21. Annular membranes attached to periphery of moveable plates are shown in the expired '084 patent; however, the '084 patent does not disclose a stationary basin member disposed within an ink reservoir. In an embodiment illustrated in FIG. 4A, the flexible membrane 22 is attached to a surface of the plate 21 that is disposed toward an exterior of the ink reservoir 19, between the moveable 21 and an ink level sensing component described below in more detail. The plate 21 may have beveled edge 21A to prevent the flexible membrane 22 from tearing or being punctured during shipping, handling or operation.

The above-referenced '333 patent discloses a means for bonding a membrane to a side plate by first adhesively bonding a protective guard to a surface of a side plate that faces away from an interior of the ink reservoir. The flexible membrane covers the protective guard and side plate and is heat bonded to the side of the plate at an area centrally located on the side plate, so the side plate is disposed within the ink reservoir. The protective guard is formed of plastic sheet material that is wider and longer than the side plate to prevent the edges of the side plate from puncturing or tearing the flexible membranes.

In contrast, the flexible membrane 22 of the disclosed embodiments of the subject invention is affixed to the plate 21 along a periphery of the plate 21 or about a central area of the plate 21 and defines a portion of the periphery thereof. As illustrated, the plate 21 has an annular protrusion 24 forming groove 47 for receiving a first end of the spring 23. The annular protrusion 24 is centrally located on the plate 21; therefore, the flexible membrane cannot be bonded to the center of the plate 21, but may be secured by suitable means such as welding to one or more points about the protrusion 24.

A second end of the spring 23 is disposed over a raised portion 27 formed on the basin member 20 and disposed within the ink reservoir 19. This portion 27 is raised in the sense that it has a surface 27A that is displaced toward the plate 21 relative to a floor 20A of the basin member 20. In addition, a recess 26 formed on the plate 21 within area defined by the annular protrusion 24 or within the annular recess 47 receives the raised portion 27 on the basin member 20 when the ink reservoir is in a collapsed position. In FIG. 4A, there is shown an ink reservoir 19 in an expanded position filled with ink, which is represented by the stippling. As ink is ejected from nozzles and through the printhead 16, the spring 23 biases the plate 21 away from the basin member 20, which is affixed to the cover plate 13, creating negative pressure in the ink reservoir 19.

In an embodiment, the spring 23 may be a helical spring. Given the configuration of the moveable plate 21, the basin 20 and the connection of the spring 23 between the two, embodiments of the invention can not incorporate bow springs as disclosed in U.S. Pat. No. 5,541,632.

The basin member 20 may be fabricated from a relatively stiff or rigid plastic material such as polyethylene. As shown in FIGS. 3, 4A and 4B, the basin member 20 has a bowl-like configuration including outwardly sloping walls 44 projecting to a ledge 45 that has a substantially flat surface on which the flexible membrane 22 is sealed or welded. With respect to FIG. 4B, the ink reservoir 19 has collapsed. As shown, the bowl-like configuration of the basin member 20 allows the flexible membrane 22 to collapse along or against a surface of the basin member 20 to prevent folding or wrinkling of the membrane 22 that may eventually cause the membrane 22 to tear. In addition, as shown in FIG. 4B, the recess 26 in the plate 21 receives the raised portion 27 on the basin member 20 and spring 23 folds into the recess 47 so the ink reservoir 19 can collapse with the flexible membrane 22 and the plate 21 is generally flush with the basin member 20 to empty as much ink as possible from the reservoir 19.

Accordingly, one or more recesses and/or grooves are disposed within the ink reservoir, which recesses and/or grooves have a sufficient depth dimension for receiving the spring 23 when the ink reservoir 19 collapses as ink is ejected from the cartridge. A recess may be disposed on the basin member 20 or the moveable plate 21. With respect to FIGS. 4C and 4D, an embodiment of the invention is shown having a first groove 47A formed in moveable plate 21 in which a first end 23A of the spring 23 is seated and a second groove 47B formed in the basin member 20 in which a second end 23B of the spring 23 is seated. The grooves 47A and 47B are generally annular grooves for embodiments incorporating a helical spring. The grooves 47A and 47B may be aligned with one another so when the ink reservoir 19 collapses the grooves 47A and 47B have a combined depth dimension to receive the spring 23. In this manner the moveable plate 21 may be generally flush against the basin member 20 to empty as much ink as possible from the reservoir 19 when the reservoir 19 collapses as ink is ejected from the cartridge 10.

Embodiments of the present invention differ from the inkjet cartridge disclosed in the '002 patent, which discloses two flexible membranes affixed to an "internal frame member." The cartridge disclosed and claimed in the '002 patent includes a frame structure which is defined as a continuous rectilinear loop structure. This frame structure does not include the covers therefor, which are independently identified. The frame structure includes an external frame member and an internal frame member. The membranes are joined to the internal frame member to form together with the frame structure, the ink reservoir.

As noted above, the flexible membrane 22 of the described embodiments of this invention is affixed to the basin member 20. However, the basin member 20 is not a component of the housing 11 or sidewall 12 as disclosed in the '002 patent. With respect to embodiments of the present invention disclosed herein, the basin member 20 (including the ledge 45 to which the flexible membrane 22 is sealed) is not attached to the sidewall 12, but may be affixed to the first cover plate 13 or otherwise secured within housing 11. Accordingly, the sidewall 12 of the subject cartridge 10 does not form the ink reservoir 19 with the membrane 22; it is the basin 20 that forms the ink reservoir 19 with the membrane 22 and moveable plate member 21. More particularly in the present inventions, inkjet cartridge 10 does not include a frame structure that together with a flexible membrane forms the ink reservoir.

The attachment of the basin member 20 and ink reservoir 19 within the housing 11 is now described. Tabs 29 are disposed along the ledge 45 of the basin 20 to secure the basin 20 to the first cover plate 13 of the housing 11. More specifically, the tabs 29 have apertures for receiving ends of posts 28 affixed to the first cover plate 13. The posts 28 may be formed as integral components of the first cover plate 13. As shown in FIGS. Projections 32 depending from the second cover plate 14 abut the tabs 29 and posts 28 to secure the basin 20 against the first cover plate 13 of the housing 11.

In the assembly of the cartridge 10, the ink reservoir 19, including the basin member 20, plate 21, flexible membrane 22 and spring 23, are placed in the housing 11 with the second cover plate 14 removed. The tabs 29 are aligned with posts 28 on the first cover plate 13, and the fill port 33 is aligned with the aperture 32 on the housing 11. The second cover plate 14 is then snapped into place with the projections 32 aligned to abut against tabs 29 on the basin member 20 and posts 28 to secure the basin member 20 and ink reservoir 19 in the housing 11. The components of the housing 11, including the sidewall 12, first cover plate 13 and second cover plate 14 may be composed of a durable plastic material such as polyethylene terephthalate glycol, or other plastic materials of suitable durability to serve as a protective casing for the ink reservoir 19.

Figure 3B:
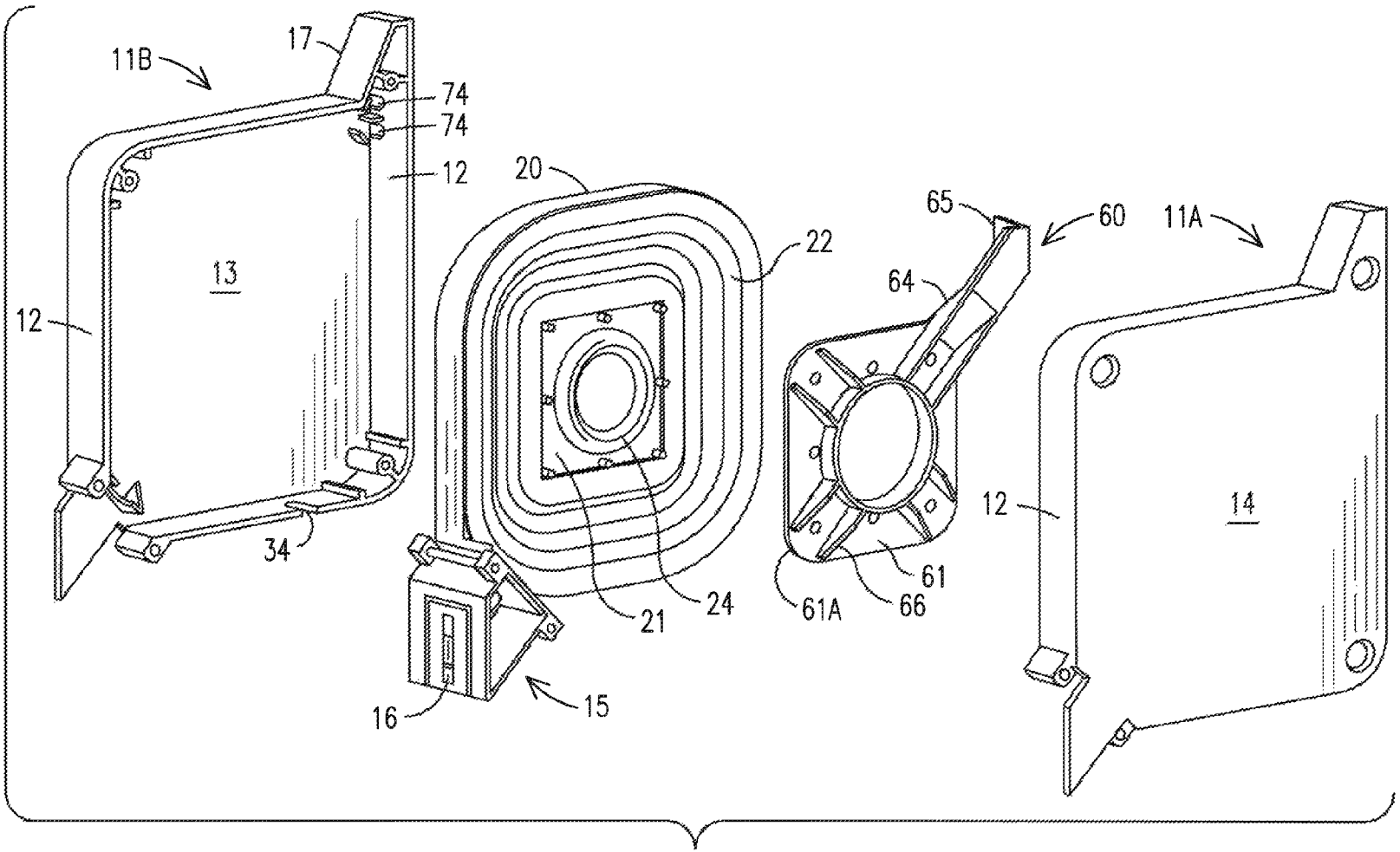
FIG. 3B is an exploded view of a second embodiment of the inkjet cartridge and internal components.

In another embodiment, the housing 11 may include the "clam-shell" configuration illustrated in FIG. 3B wherein the housing 11 includes a first half 11A affixed to a second half 11B. The halves 11A and 11B each include cover plates 13 and 14 respectively and portions of the sidewall 12 to form the housing 11. The cover plates 13, 14 and respective sidewalls form the housing 11. The halves 11A, 11B can be secured to one another using methods such as screwing the halves together, ultrasonically welding the halves together, or bonding the halves together using a suitable or other bonding agent. In addition, in either embodiment illustrated in FIG. 3A or 3B, the basin member 20 is secured against one of the halves 11A or 11B, or one of the cover plates 13 or 14. More specifically, both the basin member 20 and housing 11 may have support ribs that engage one another to minimize any lateral movement of the basin member 20 or the ink reservoir 19 in the housing 11. In either embodiment, the basin member 20 is secured within the housing 11 and remains stationary relative to movement of the plate 21.

In an embodiment, the basin member 20 and plate 21 are composed of the same rigid plastic material such as polyethylene, and the flexible membrane is composed of a different plastic material that is pliable enough to allow the plate 21 to move relative to the stationary basin member 20, durable enough to prevent tearing and compatible with the plastic material of the basin member 20 and plate 21 so the flexible membrane 22 may adequately sealed to the basin member 20 and plate 21. As described in more detail below, the flexible membrane 22 may comprise a laminate structure that includes a polyethylene cattier layer, a polypropylene sealant layer and a metallized plastic layer.

The inkjet cartridge disclosed in the '002 patent, describes and claims the composition of some of the components in terms of a first plastic material, second plastic material and third plastic material. More specifically, there is disclosed a cartridge that includes an external frame member that is fabricated from a first rigid plastic material and an interior frame member fabricated from a second plastic material that is different than the first plastic material, and two membranes composed of a third plastic material. The second and third plastic materials are compatible with one another to form a leak-proof joiner. In the specification of the '002 patent at column 3, lines 21-23, an example of the first plastic material is a glass-filled modified polyphenylene oxide sold under a trademark NORYL. An example of the second plastic material is a polyolefin alloy or ten percent glass-filled polyethylene, which was chosen in part because it adheres to the NORYL. An example of the third plastic material for the membranes is listed as ethylene-vinyl acetate. Thus both of the membranes disclosed in the '002 patent are composed of the same third plastic material, which is different than the first and second plastic materials.

Embodiments of the present invention disclosed herein include the housing 11 that is composed of a first plastic material and the ledge 45 of the basin member 20, on which the flexible membrane 22 is sealed, is composed of a second plastic material. However, the remaining portion of the basin member 20 is composed of the same second plastic material. In addition, the flexible membrane 22 is composed of a material, including the plastic laminate structure that is different than the remaining portion of the basin member 20.

Figure 12:
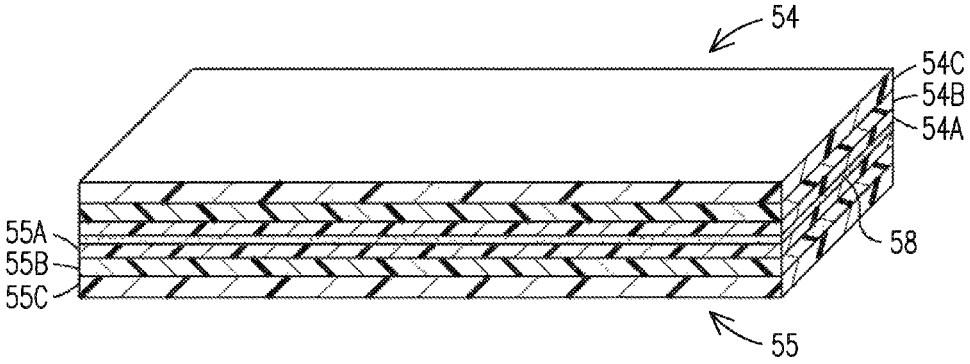
FIG. 12 is schematic illustration of a first embodiment of a laminate structure for a flexible membrane of the ink reservoir.

The flexible membrane 22, of the present invention, may require barrier characteristics to prevent the migration of solvents of the ink from the reservoir. For example, the flexible membrane 22 may be composed of a laminate structure having including two laminate layers affixed to one another. As shown in FIG. 12, each of a first and second laminate layers 54 and 55 respectively includes a carrier layer (54A, 55A), a barrier layer (54B, 55B) affixed to the carrier layer (55A, 55B) and a sealant layer (54C, 55C) affixed to the barrier layer (54B, 54B) sandwiching the barrier layer (54B, 54B) between carrier (54A, 55A), and sealant layers (54C, 55C). The laminate layers 54 and 55 are affixed to one another at their respective carrier layers (54A, 55A) by an adhesive 58. A flexible membrane 22 with the above described laminate structure may be acquired through packaging manufacturer Curwood, located in Oshkosh, Wis.

Such a laminate structure differs from the laminate structure disclosed in the '112 patent, which includes laminate materials having the carrier layer sandwiched between the barrier layer and a sealant. In addition, in the '112 patent, the barrier layer for each respective laminate layer is affixed to one another to form the laminate structure. Such a laminate structure differs from the present invention, which has the carrier layers (54A, 55A) affixed to one another to form the laminate structure.

Figure 13:
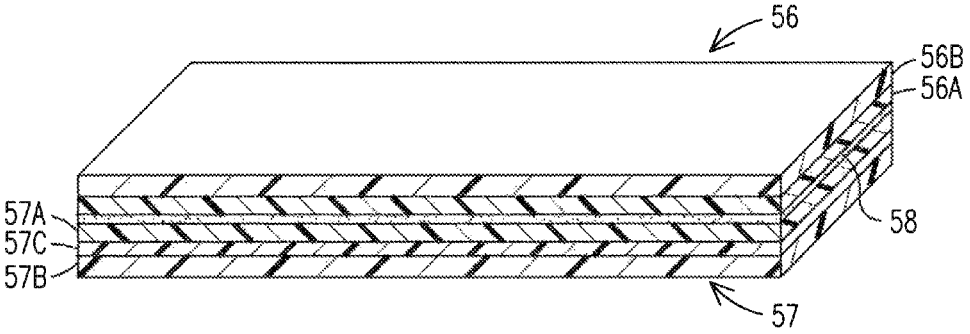
FIG. 13 is a schematic illustration of a second embodiment of a laminate structure for a flexible membrane of the ink reservoir.

In another embodiment, as shown in FIG. 13, the laminate structure includes first and second laminate layers 56 and 57. The first laminate layer includes a carrier layer 56A and a sealant layer 56B. The second laminate layer 57 includes a carrier layer 57A and a sealant layer 57B with a barrier layer 57C disposed there between. The first and second laminated layers 56, 57 are affixed to one another by an adhesive 58. In either of the above described laminate materials, the carrier layer may be composed of polyethylene and the sealant may be composed of a material such as polypropylene, which is compatible with the polyethylene comprising the basin member 20 and plate 21 for attaching the flexible membrane 22. The barrier layer may be composed of ethylene vinyl alcohol or other plastic material coated with a metal such as aluminum.

The above described laminate structure provides a membrane 22, while inelastic, is flexible. In the assembly of the cartridge 10, after the membrane has been welded to the basin member 20 and the moveable plate 21, and the spring 23 having been seated in the reservoir 19, the membrane 22 is collapsed into the basin membrane 20. As a result of the inelastic characteristic of the membrane 22 a wrinkle pattern is formed or a flexing memory is created in the membrane 22. In this manner, the membrane 22 and spring 23 can be expanded to maximize the volume of the ink reservoir 19. In addition, when the membrane 22 collapses during printing operations, the membrane 22 may more readily conform to the shape of the basin member 22. Accordingly, the expansion/contraction stroke of the spring 23 is maximized so the negative pressure in the ink reservoir 19 is effectively maintained to drain ink from the ink reservoir, and thereby extending the life of the cartridge 10. As described above, the membrane 22 is not preformed by the thermal forming methods disclosed in the '324 patent.

A more detailed description of the basin member 20, snout 15 and their components is provided. More specifically, with respect to FIG. 5, a channel 35 is formed in the basin member 20 and leads to the snout 15. A support member 39 is integrally formed with the basin member 20 and connects the snout 15 to the basin member 20. The channel 35 extends through the support member 39 providing fluid communication between the ink reservoir 19 and the snout 15. A standpipe 38 disposed in the snout 15 between the channel 35 and printhead 16, connects the printhead 16 and nozzles (not shown) in fluid communication with the ink reservoir 19.

Figure 5:
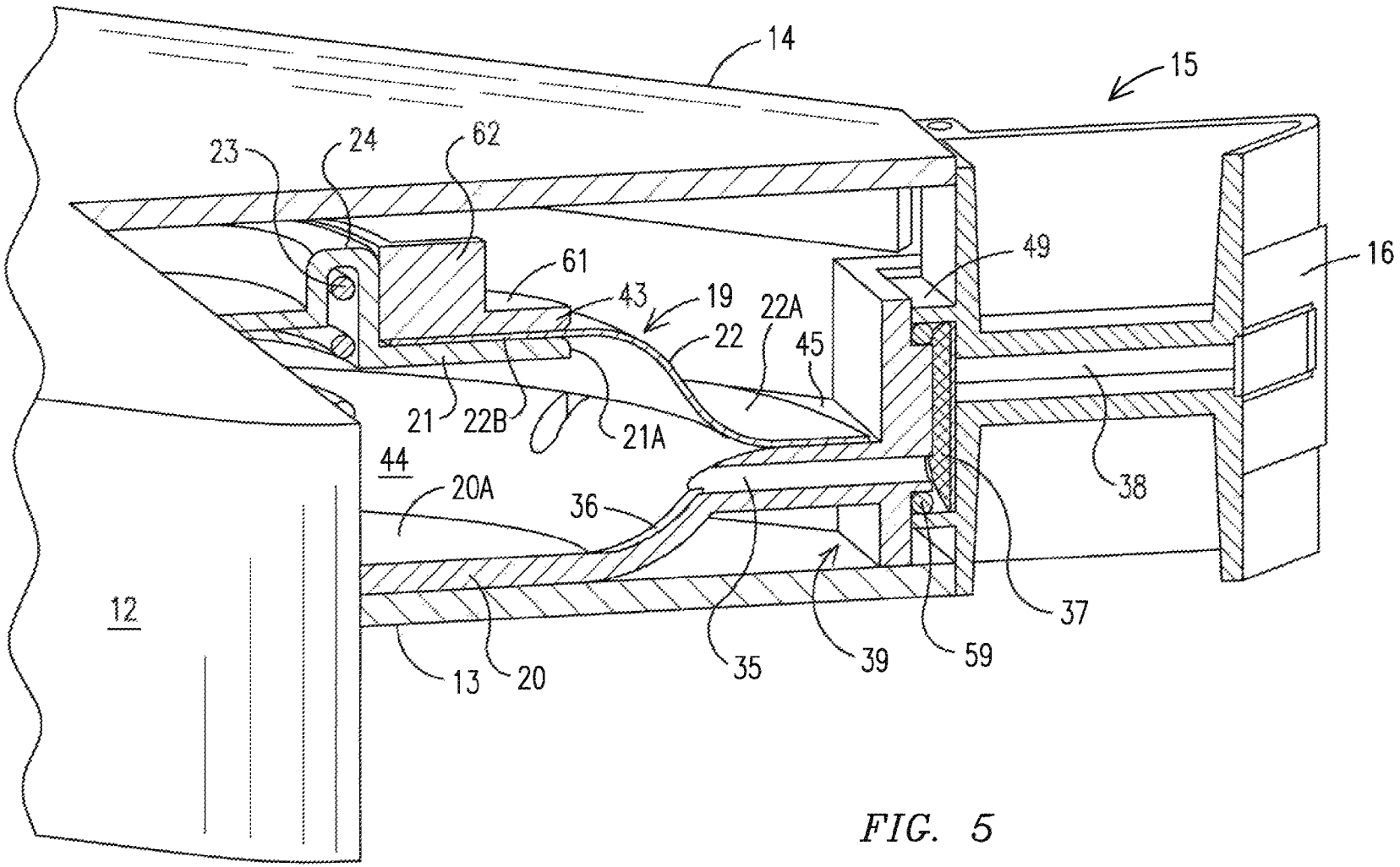
FIG. 5 is a perspective sectional view of the inkjet cartridge including a snout attached to the cartridge housing.
Figure 6A:
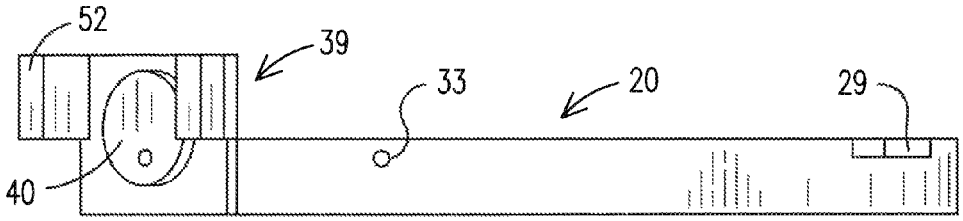
FIG. 6A is an elevational view of the basin of the ink reservoir showing a fill port and an aperture leading to the snout.
Figure 6B:
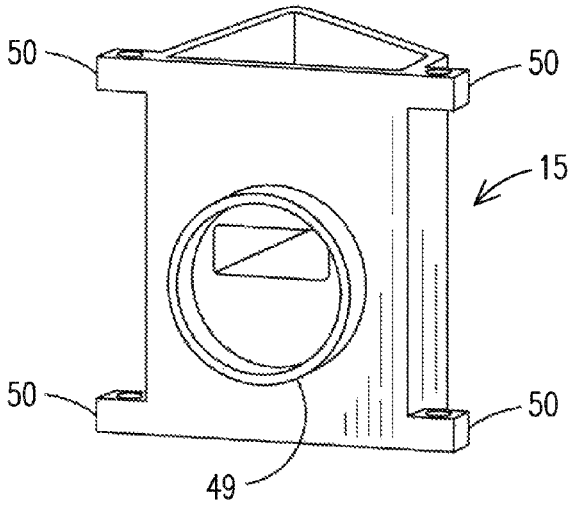
FIG. 6B is a rear perspective view of the snout ring and tabs for attachment to the basin member and housing.

The snout 15 is fabricated as a component independent of the housing 11 and basin member 20, and may be composed of any durable plastic and dimensionally stable plastic material such as a glass-filled polyphenylene sulfide resin. As shown in FIGS. 3A and 3B, tabs 50 on the housing 11, snout 15 and basin member 20 are aligned relative to one another and pins 53 are inserted through the tabs 50 to secure the snout 15 to the housing 11 and basin member 20. With respect to FIGS. 6A and 6B respectively, the support member 39 is illustrated having a hub 48 for receiving the ring 49 on the snout 15 and positioning the standpipe 38 relative to the channel 35. An o-ring 59 is disposed between the hub 48 and ring 49. In FIG. 5, a screen 37 is disposed between the support member 39 and snout 15 to filter air bubbles, debris etc. from ink traveling from the ink reservoir 19 through the channel 35 to the standpipe 38 and printhead 16.

Figure 7C:
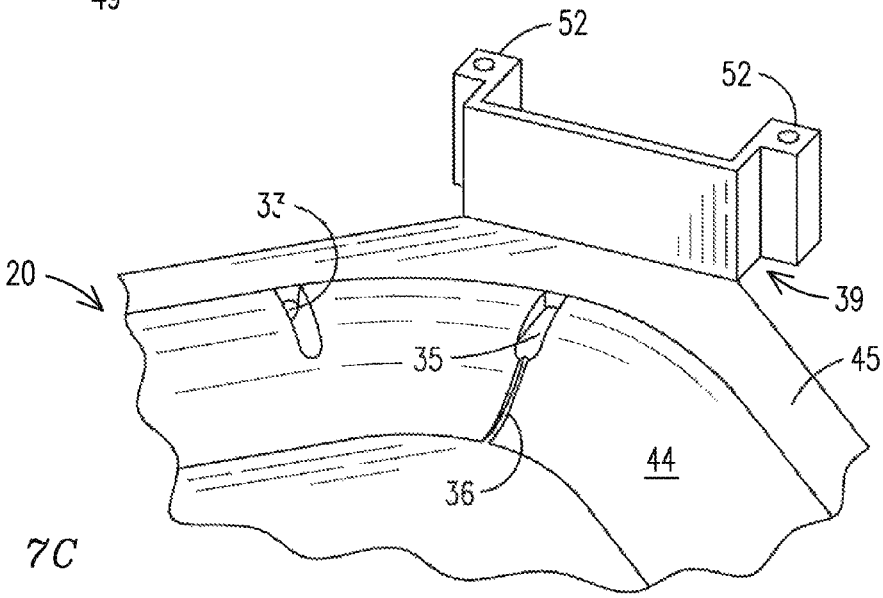
FIG. 7C is a perspective view of the basin member showing a channel, chute and fill port.
Figure 7A:
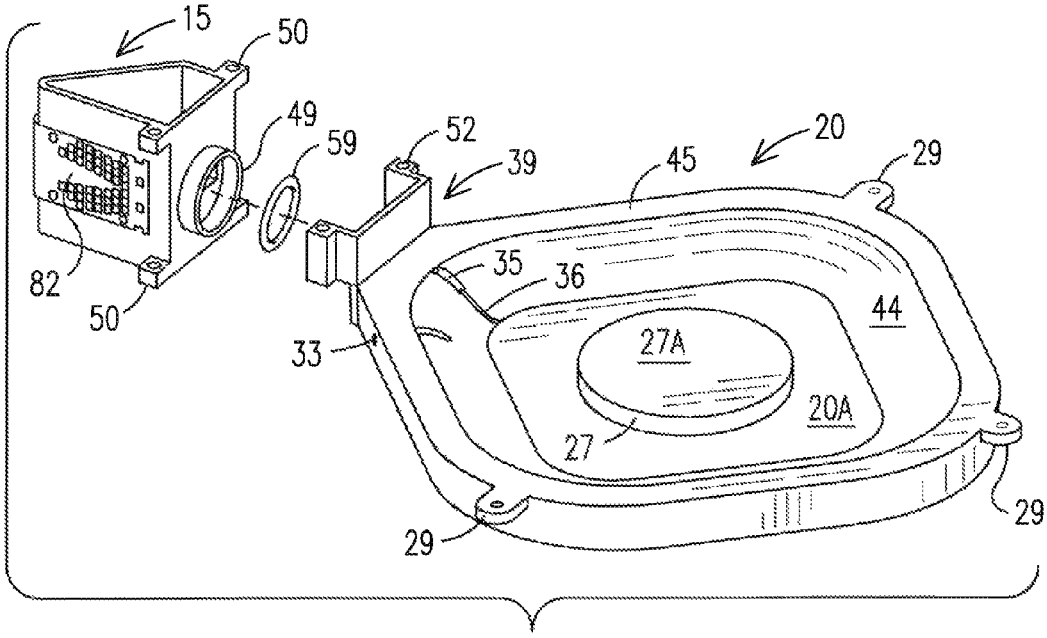
FIG. 7A is an exploded perspective view of the snout aligned for attachment to the basin member.
Figure 7B:
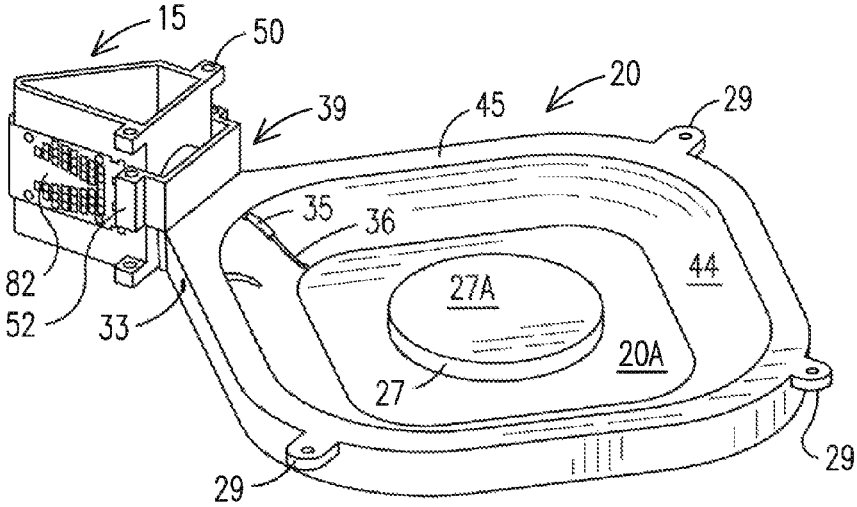
FIG. 7B a perspective view of the snout aligned for attachment to the basin.
Figure 9:
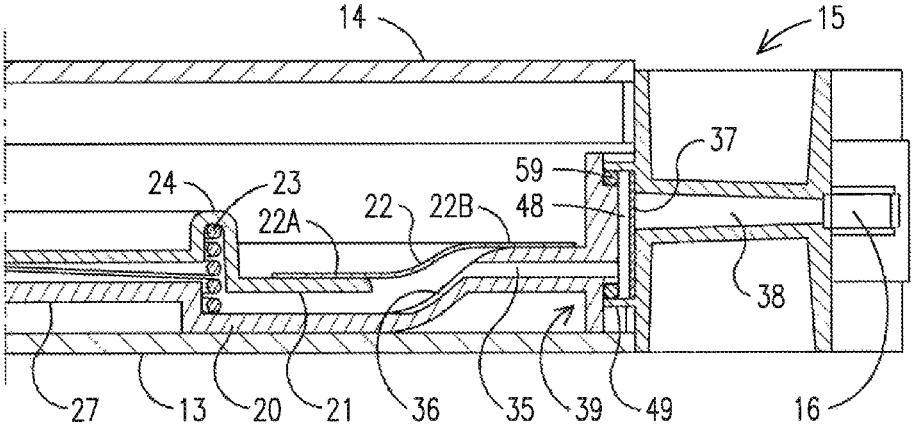
FIG. 9 is a sectional view of the inkjet cartridge with the ink reservoir illustrating the flexible membrane collapsed over the channel.

Also with respect to FIGS. 5 and 7C, there is formed in the wall 44 of the basin member 20 a chute 36 that extends between the floor 20A of the basin 20 and the channel 35. The chute 36 allows for ink from the reservoir 19 to continue to be supplied to the printhead 16 when plate 21 and flexible membrane 22 are collapsing. As illustrated in FIG. 9, when the flexible membrane 22 is collapsing into the basin 20, the membrane 22 may block the opening to the channel 35; however, ink may still travel to the channel 35 and to the printhead 16 via the chute 36. In this manner, a maximum volume of ink can be withdrawn from the reservoir 19 minimizing the wasting of ink, especially if the cartridge is disposable.

Figure 8:
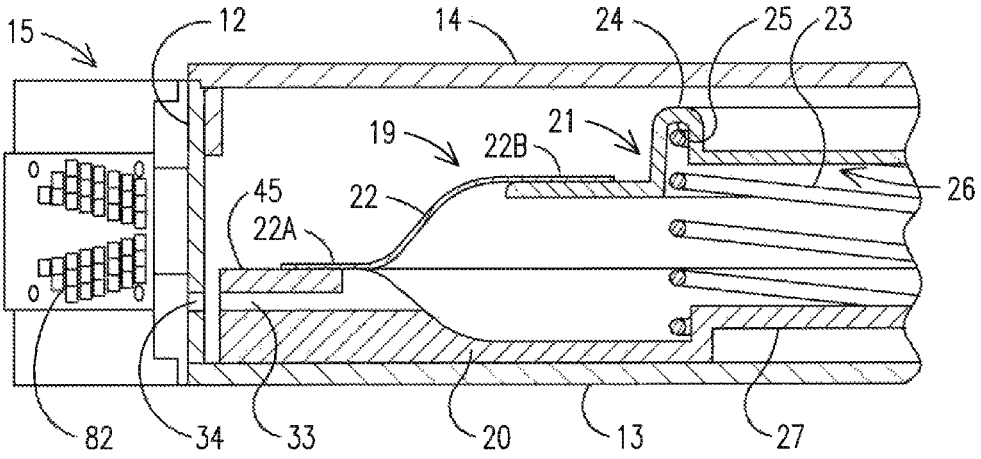
FIG. 8 is a sectional view of the cartridge showing the fill port of the basin aligned with an aperture in cartridge housing for filling the ink reservoir with ink.

In the basin member 20 there is also provided a fill port 33 through which ink is injected into the ink reservoir 19. As shown, in FIG. 8, an aperture 34 in housing 11 is aligned with the fill port 33 to fill the ink reservoir 19 after it has been mounted within the housing 11, and the snout 15 is attached to the basin 20 and housing 11. With respect FIG. 3A, tabs 50, 51 and 52 on the snout 15, housing 11 and basin 20 respectively, are positioned with respect to one another to secure to secure the snout 15 to the basin 20 and the housing 11. Pins 53 inserted through the tabs 50, 51 and 52 secure the snout 15, basin 20 and housing 11 to one another.

The ink reservoir 19 may be filled after it is installed in the housing 11, and after the snout is attached to the basin member 20 and housing 11. A plug or stopper may be inserted in the fill port 33 after filling the reservoir 19 with ink, and the aperture 34 may be covered with a cap, tape, label or other suitable means to close off the interior of the cartridge 10. Filling the ink reservoir 19 may be done by using techniques known to those skilled in the art. For example, a gravimetric or vented fill may be used wherein a needle is inserted through aperture 34 on the housing 11 and into fill port 33 with the ink reservoir 19 in an expanded state. Ink is injected into the reservoir 19 through the fill port 33. Displaced air may escape through spacing between the needle and fill port 33. Any remaining air may be removed when the inkjet cartridge 10 is primed by providing a vacuum suction to the printhead 16 and nozzles. Another known method for filling the ink reservoir. The nozzles on printhead 16 are plugged. A needle is connected to a vacuum source and an ink source. A vacuum is first pulled to collapse the ink reservoir and a valve is turned and a predetermined amount of ink is injected into the reservoir 19. The cartridges is then primed via drawing a vacuum through nozzles to remove any excess air within the reservoir.

Figure 14:
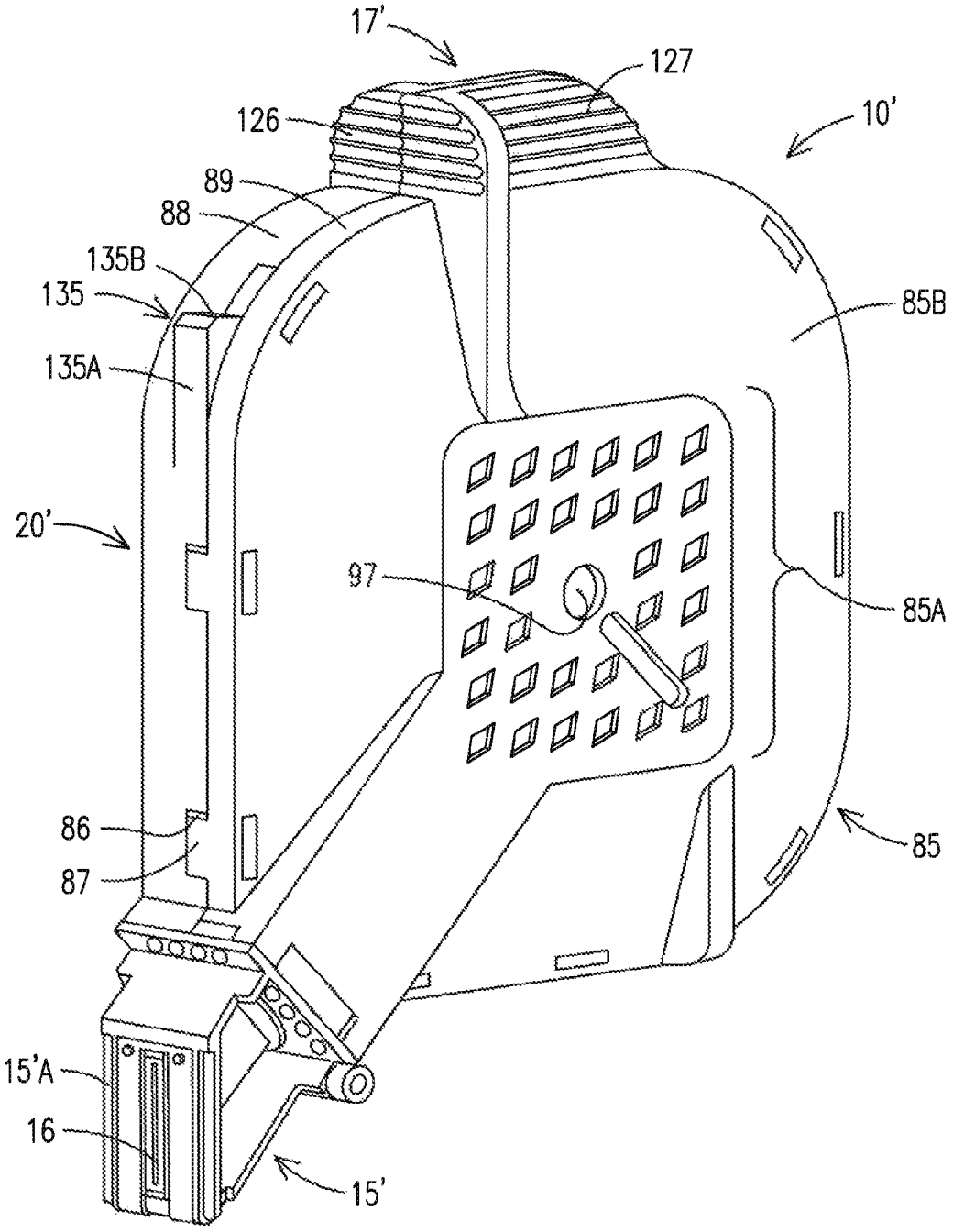
FIG. 14 is a top perspective view of a third embodiment of an inkjet cartridge.
Figure 15:
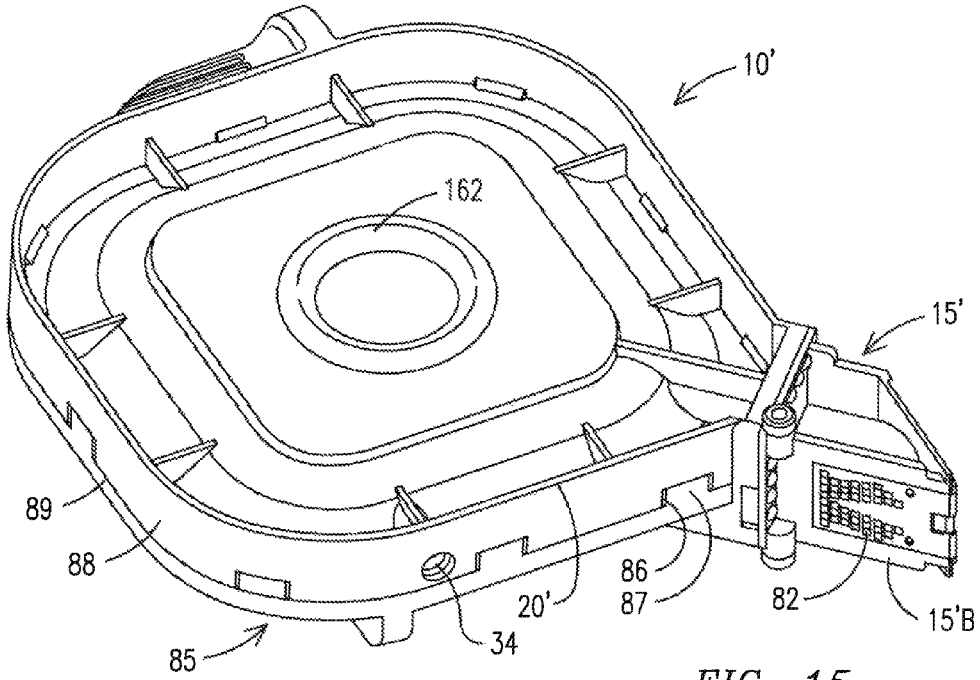
FIG. 15 is a bottom perspective view of the of the inkjet cartridge shown in FIG. 14.
Figure 16:
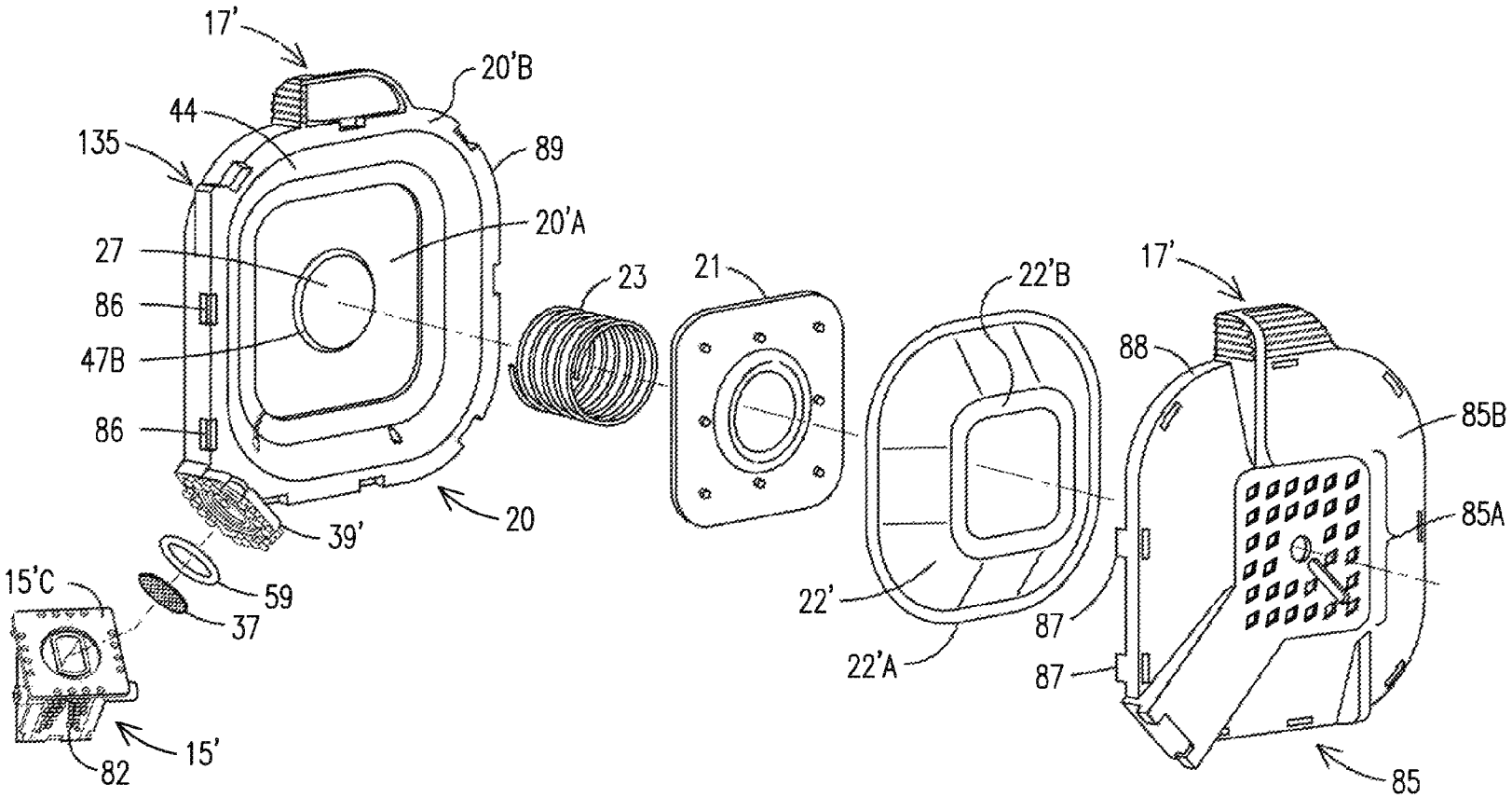
FIG. 16 is an exploded view of the inkjet cartridge shown in FIG. 14.

With respect to FIGS. 14, 15 and 16, there is illustrated a third embodiment of the inkjet cartridge 10' that does not include the external housing 11 of the previously described embodiments. Instead a rigid cover 85 is mounted to the basin member 20' so that the cover 85 with the basin 20' forms a rigid durable housing or casing having an interior in which the ink reservoir 19' is disposed and protected. As shown, the basin member 20' includes a plurality of notches 86, disposed along an outer peripheral edge 88 of the basin member 20'. Tabs 87 descend from an outer peripheral edge 89 of the cover 85 and fit in mating relationship with the notches 86 to snap and secure the cover 85 to the basin 20'. Similar to the previously described embodiments, the basin 20', flexible membrane 22' and the rigid moveable plate 21 are positioned and secured relative to one another to form the ink reservoir 19'.

Figure 17A:
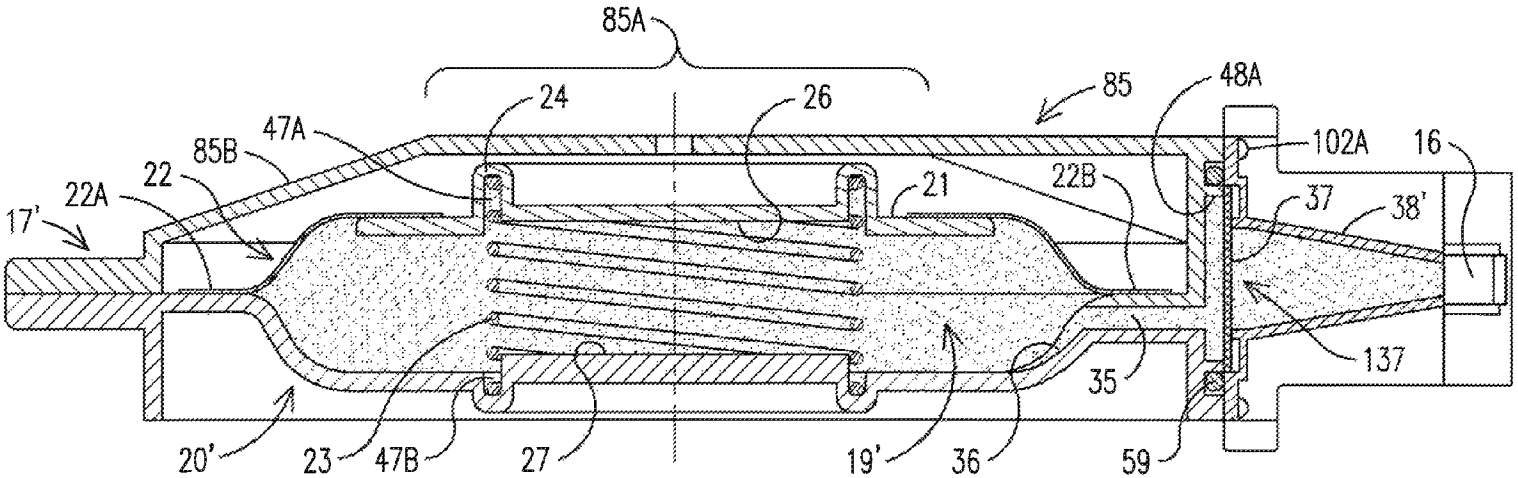
FIG. 17A is a sectional view of the inkjet cartridge shown in FIG. 14 with the ink reservoir expanded and filled with ink.
Figure 17B:
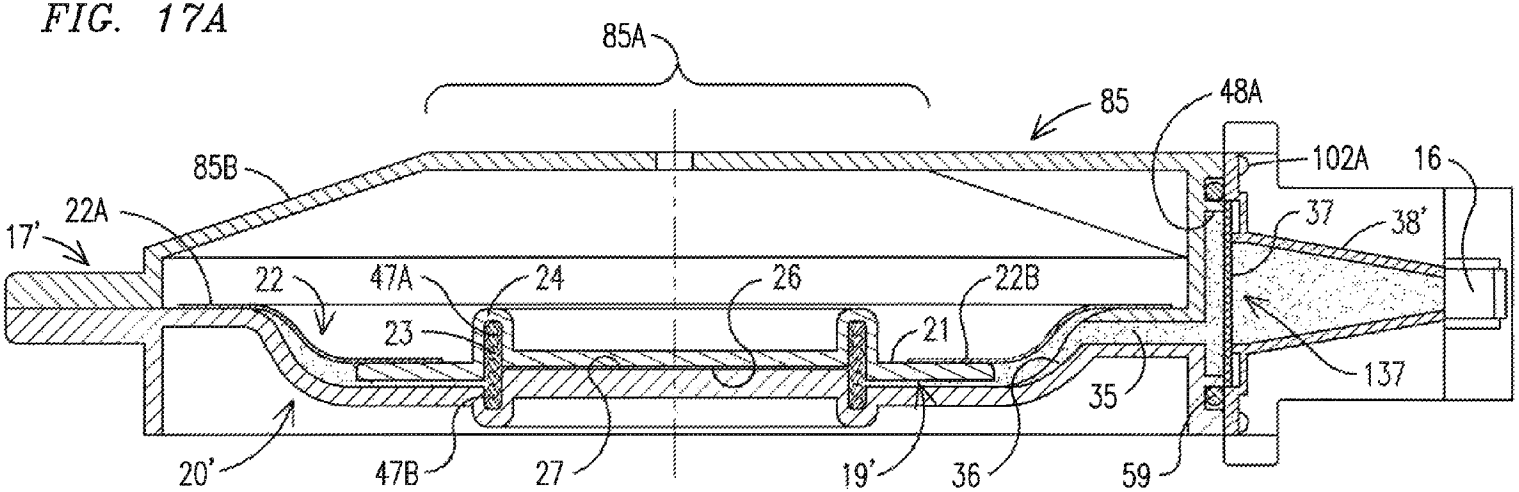
FIG. 17B is a sectional view of the inkjet cartridge shown in FIG. 14 with the ink reservoir having collapsed.

In reference to the ink reservoir 19' shown in FIGS. 17A and 17B, and as in the previously described embodiments, a spring 23 is disposed within the ink reservoir 19 between the basin member 20' and the plate 21, and biases the plate 21 away from the basin member 20' to generate a negative or back pressure in the ink reservoir 19' to prevent ink from drooling from the nozzles on the printhead 16. As ink is ejected during printing and other operations, the flexible membrane 22' collapses towards the basin member 20' causing the plate 21 to move towards the basin member 20'. The spring 23 biasing force against the plate 21 generates the negative pressure in the ink reservoir 19'.

Figure 4C:
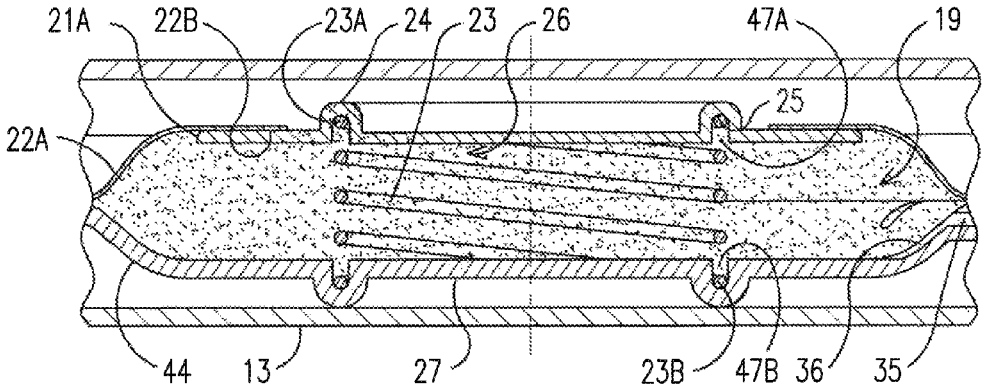
FIG. 4C is a sectional view of the inkjet cartridge with an ink reservoir in an expanded position.
Figure 4D:
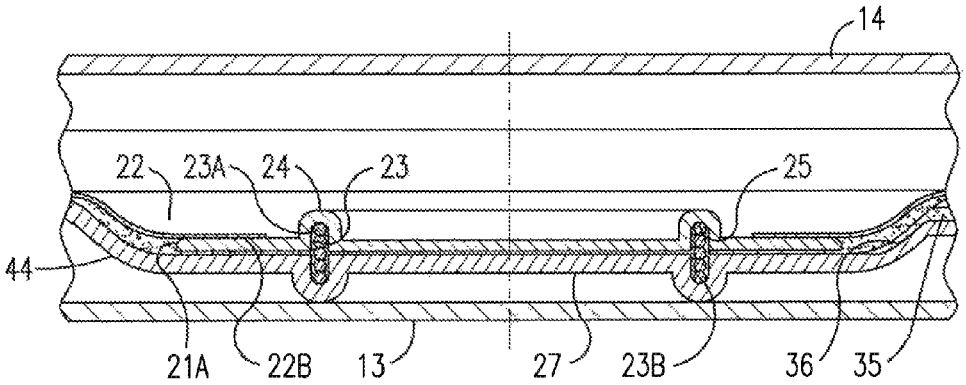
FIG. 4D is a sectional view of the inkjet cartridge with an ink reservoir in a collapsed position.

The spring 23 may be seated against the plate 21 and basin member 20' similar to the embodiment shown in FIGS. 4C and 4D. In addition, a similar configuration to that shown in FIGS. 4A and 4B or other design may be used so the flexible membrane 22' and plate 21 collapses a sufficient dimension to allow as much ink as possible to be empty the reservoir 19' of ink. The grooves 47A and 47B are generally annular grooves for embodiments incorporating a helical spring. The grooves 47A and 47B may be aligned with one another so when the flexible membrane 23 and plate 21 collapse, the grooves 47A and 47B have a combined depth dimension to receive the spring 23.

In reference to FIGS. 17A and 17B, the cover 85 includes a middle section 85A that is laterally displaced relative to the outer peripheral edge 89 of the cover 85 and away from the basin member 20' so that sides 85B of the cover 85 are angled obliquely relative to the midsection 85 and peripheral edge 89. In this manner, as shown in FIG. 17A, at least a portion of the ink reservoir 19' including a portion of the moveable plate 21, flexible membrane 22' and/or spring 23 are surrounded by the cover 85, or the cover 85 receives a portion of the ink reservoir when the reservoir 19' is filled with ink and in an expanded state.

In addition, the bowl-like configuration of the basin member 20' that includes a rim 20'B and the wall 44 sloping to the floor 20'A allows the flexible membrane 22' to collapse along a surface of the basin member 20'. In addition, a recess 26 in the plate 21 receives a raised portion 27 on the basin member 20' so the moveable plate 21 may be generally flush against the basin 20' to empty as much ink as possible from the reservoir 19'. Moreover, as the flexible membrane 22' collapses it may follow the contour of the wall 44 and is generally flush with the surface of the basin member 20'.

Similar to the above describe embodiments, the basin member 20' remains stationary while the flexible membrane 22' and plate 21 move relative to the basin 20'. Accordingly, this embodiment includes a single membrane 22' and single plate 21 that move relative to the stationary basin 20', which is different than the cartridges disclosed in the patents cited in paragraph 05 above. The above-cited patents include two side plates to which two flexible membranes are affixed; and, the side plates move relative to one another.

The flexible membrane 22' may have the annular configuration shown in FIG. 16 and in the previous embodiments, having a first peripheral edge 22'A sealed against the basin member 20' and a second peripheral edge 22'B sealed against the moveable plate 21. As shown in FIGS. 17A and 1713, the edge 22'A of the flexible membrane 22' is spaced inwardly relative to the outer peripheral edge 89 of the basin member 20'. In addition, the flexible membrane 22' of the subject invention is affixed to the plate 21 along a periphery of the plate 21 or about a central area of the plate 21 and defines a portion of the periphery thereof. As illustrated, the plate 21 has an annular protrusion 24 forming a groove or recess 47A for receiving a first end of the spring 23. The annular protrusion 24 is centrally located on the plate 21; therefore the flexible membrane 22' is not bonded to the center of the plate 21, but may be secured by suitable means such as welding to one or more points about the protrusion 24 along a periphery of the plate 21.

In an embodiment, the cover 85 may be composed of durable plastic material such as polyethylene or other plastic materials of suitable durability to serve as a protective casing for the ink reservoir 19'. The basin member 20' and plate 21 are composed of the same rigid plastic material such as polyethylene, and the flexible membrane is composed of a different plastic material that is pliable enough to allow the plate 21 to move relative to the stationary basin member 20', durable enough to prevent tearing and compatible with the plastic material of the basin member 20' and plate 21 so the flexible membrane 22' may be adequately sealed to the basin member 20' and plate 21. As described in more detail below, the flexible membrane 22' may comprise a laminate structure that includes a polyethylene carrier layer, a polypropylene sealant layer and a metallized plastic layer.

Figure 20:
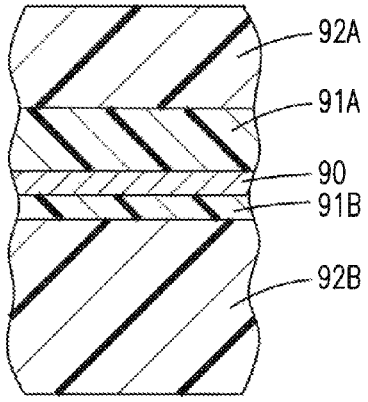
FIG. 20 is a sectional schematic view of the flexible membrane of the ink reservoir.

The flexible membrane 22', of the present invention, may require barrier characteristics to prevent the migration of solvents of the ink from the reservoir. For example, the flexible membrane 22' may be composed of a laminate structure. More specifically in reference to FIG. 20, the laminate structure includes a barrier layer 90 disposed between two carrier layers 91A and 91B; and, two sealant layers 92A and 92B respectively disposed on each carrier layer 91A and 91B external of the barrier layer 90. The barrier layer 90 may be composed of ethylene vinyl alcohol or other plastic material coated with a metal such as aluminum. The carrier layer 91 may be composed of polyethylene and the sealant layer may be composed of polypropylene or other plastic material that is compatible with the materials comprising the basin member 20' and plate 21 to seal the flexible membrane 21 against these components. In an embodiment, respective edges 22'A and 22'B are heat sealed against the basin member 20' and plate 21 using techniques or processes known to those skilled in the art.

The above-described laminate structure provides a membrane 22', while inelastic, is flexible. In the assembly of the cartridge 10, after the membrane has been welded to the basin member 20' and the moveable plate 21, and the spring 23 having been seated in the reservoir 19', the membrane 22' is collapsed into the basin membrane 20. As a result of the inelastic characteristic of the membrane 22' a wrinkle pattern is formed or a flexing memory is created in the membrane 22'. In this manner, the membrane 22' and spring 23 can be expanded to maximize the volume of the ink reservoir 19'. In addition, when the membrane 22 collapses during printing operations, the membrane 22' may more readily conform to the shape of the basin member 22. Accordingly, the expansion/contraction stroke of the spring 23 is maximized to drain ink from the ink reservoir while negative pressure in the ink reservoir 19' is effectively maintained and, thereby minimizing the amount of stranded ink. Similar to the other above-described embodiments, the membrane 22' is not preformed by the thermal forming methods disclosed in the '324 patent.

Also with respect to FIGS. 16, 17A and 17B, there is formed in the wall 44 of the basin member 20' a chute 36 that extends between the floor 20'A of the basin 20' and the channel 35. The chute 36 allows for ink from the reservoir 19 to continue to be supplied to the printhead 16 when the plate 21 and flexible membrane 22' are collapsing. As illustrated in FIG. 17B, when the flexible membrane 22' is collapsing into the basin 20', the membrane 22' may block the opening to the channel 35; however, ink may still travel to the channel 35 and to the printhead 16 via the chute 36. In this manner, a maximum volume of ink can be withdrawn from the reservoir 19' minimizing the wasting of ink, especially if the cartridge is disposable.

Figure 16A:
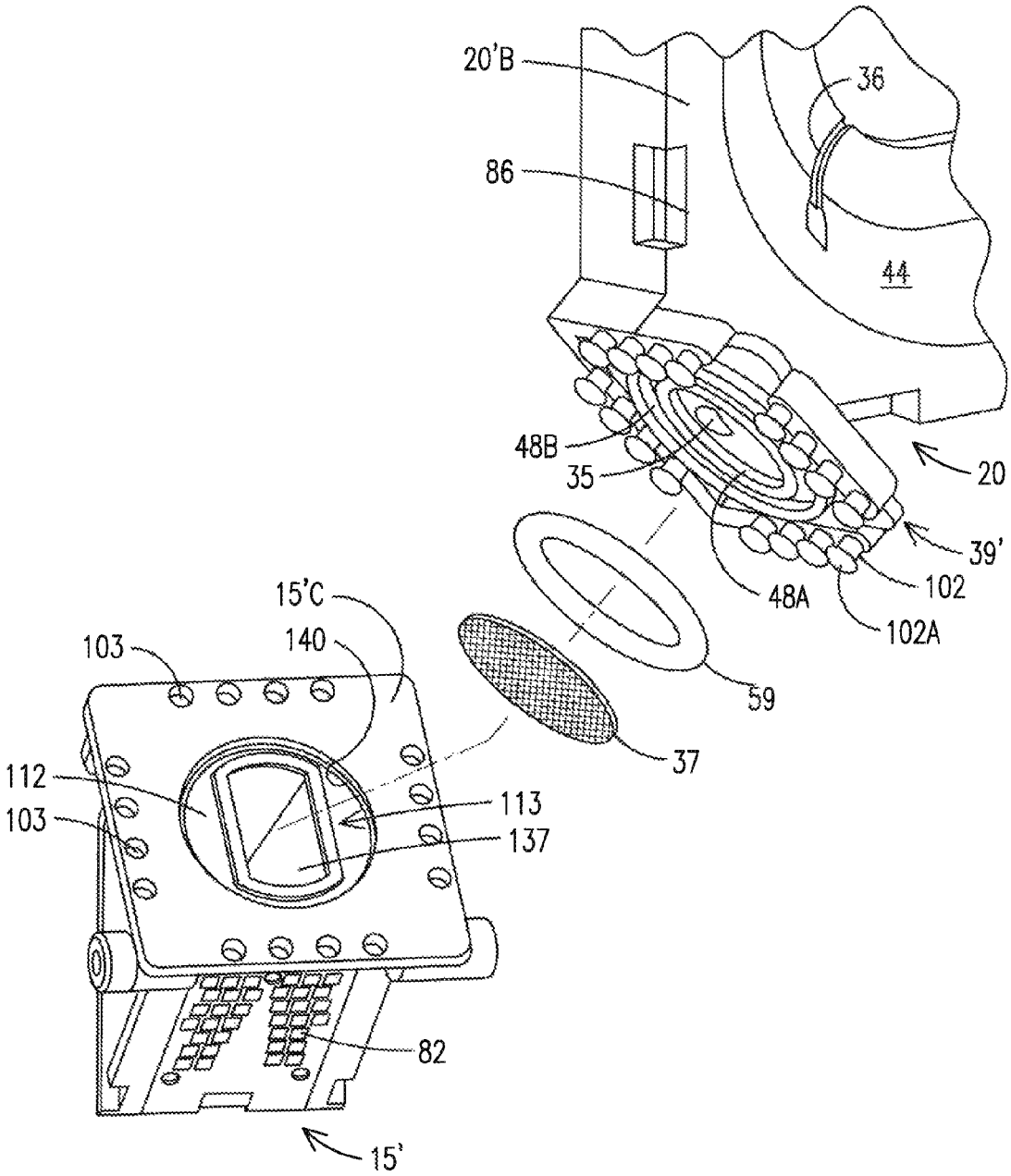
FIG. 16A is an expanded view of the attachment of the snout to the basin member.

A more detailed description of the basin member 20', snout 15' and their components is provided. In reference to FIGS. 16, 16A, 17A and 17B, the snout 15' is secured directly to the basin member 20' and includes the printhead 16 mounted thereon and nozzles (not shown) in fluid communication with the ink reservoir 19' to eject ink from the cartridge per printing commands. The printhead 16 is mounted to a first surface 15'A of the snout 15', and an electrical interconnect is mounted to a second surface 15'B to place the printhead 16 in electrical communication with a printing system controller. As illustrated in FIG. 16A, the snout 15' is attached to the basin member 20' and cover 85 as a separate component and is not integrally formed with the either of these components. The snout 15' is fabricated as a component independent of the basin member 20' and cover 85, and may be composed of any durable plastic and dimensionally stable plastic material such as a glass-filled polyphenylene sulfide resin.

With respect to FIGS. 17A and 17B, a channel 35 is formed in the basin member 20' and leads to the snout 15'. A support member 39' is integrally formed with the basin member 20' and supports the snout 15' on the basin member 20'. The channel 35 extends through the basin member 20' and past the support member 39' providing fluid communication between the ink reservoir 19' and the snout 15'. A standpipe 38' disposed in the snout 15' between the channel 35 and printhead 16, connects the printhead 16 and nozzles (not shown) in fluid communication with the ink reservoir 19'.

The snout 15' may be mounted to the basin 20' and support member 39' using a heat stake process. More specifically, a plurality of pegs 102 are formed on the support member 39' during a molding process. A flange 15'C on the snout 15' includes a plurality of holes 103 through which the pegs 102 are inserted. Using a heat staking process, support member 39' and flange 15'C are clamped together and the ends of the pegs 102 are heated forming the rivet heads 102A on the pegs 102 securing the snout 15' to the basin member 20' and support member 39'.

As shown FIGS. 16A, 17A and 17B an o-ring 59 is disposed between the support member 39' and snout 15' to seal the interface between the two components and prevents ink passing from the ink reservoir 19 to the snout 15' from leaking from the cartridge 10'. More specifically, the support member 39' includes two concentric rings including an inner-hub 48A and outer-hub 4813 between which an o-ring 59 is seated. The side of the snout 15' facing the basin member 20' has a circular recess 112 forming a rim 140. The recess 112 has a diameter that is slightly larger than the diameter of the screen 37, which seats within the recess 112 and against hub 113. The o-ring 59, which is seated between the inner hub 48A and the outer hub 48B on support member 39', has a diameter that is larger than that of the recess 112 on the snout 15' and is seated against the surface of the snout 15' facing the support member 39'. In addition, the hub 113 is disposed within the recess 112 and surrounds a first opening 137 on the basin side of the snout 15' that leads to the standpipe 38'. The screen 37 is secured against the hub 48A on the basin 20' and the hub 113 on the snout 15' by application of a heat stake process, which, with the o-ring 59, provides a sealed interface between the channel 35 and standpipe 38' and between the snout 15' and support member 39'. The screen 37 may filter debris from the ink passing to the printhead 16 on the snout 15'; and, as described below, the screen 37 may prevent gas bubbles from passing from the standpipe 38' to the ink reservoir 19.

Figure 23:
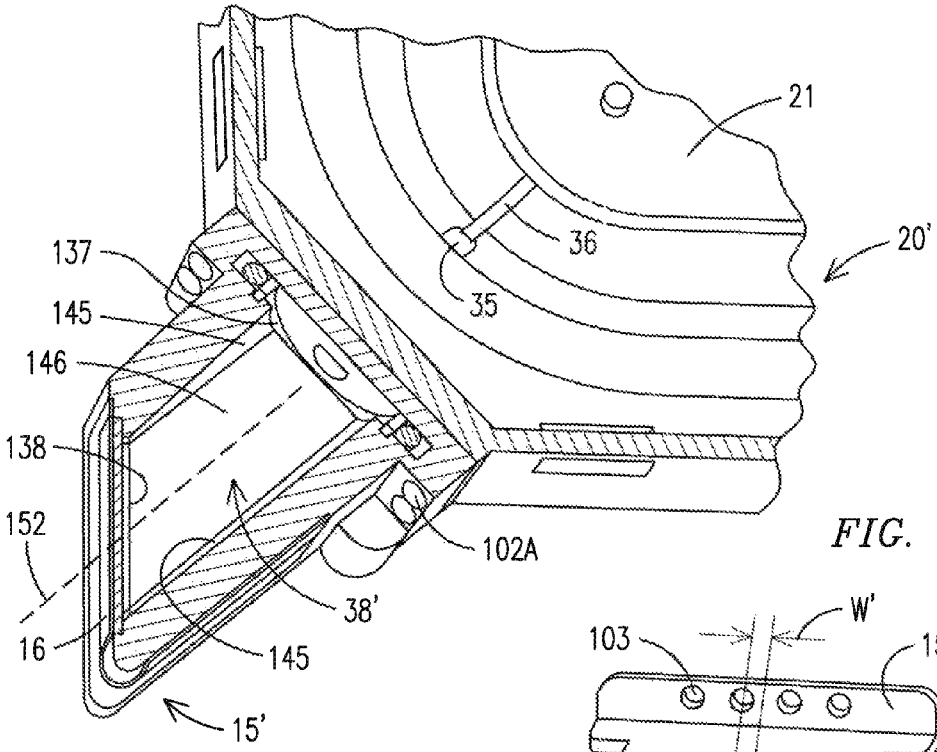
FIG. 23 is a sectional view of the snout showing an interior of the snout.
Figure 21:
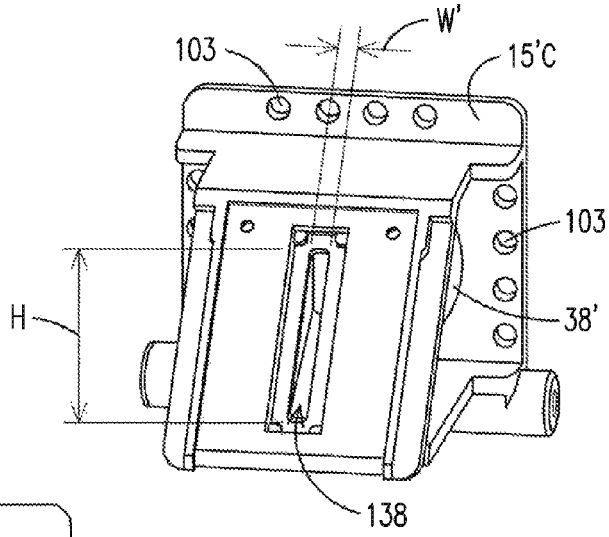
FIG. 21 is a perspective of the snout showing an opening of a standpipe in the snout at the printhead.
Figure 22:
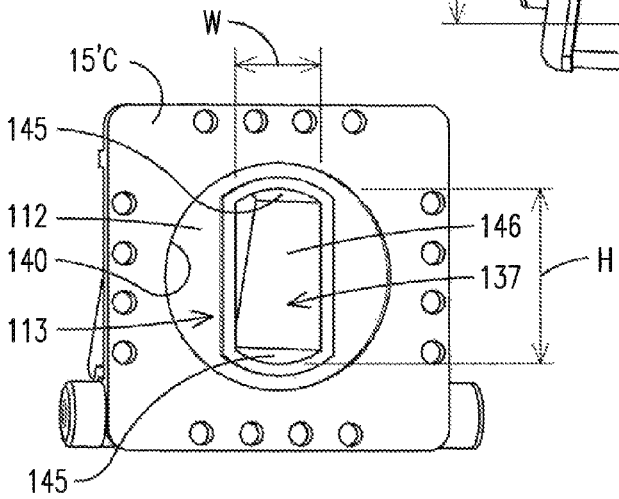
FIG. 22 is a perspective of the snout showing an opening of a standpipe in the snout at the basin side of the inkjet cartridge.

In reference to FIGS. 17A, 17B, 21 through 23, the snout 15' and standpipe 38' are illustrated in more detail. The standpipe 38' includes the first opening 137 that is adjacent to the screen 37 and channel 35, and a second opening 138 adjacent to the printhead 16. In addition, as shown in FIG. 23 the standpipe 38' has a longitudinal axis 152 that is disposed at an acute angle relative to the printhead 16.

Figure 24:
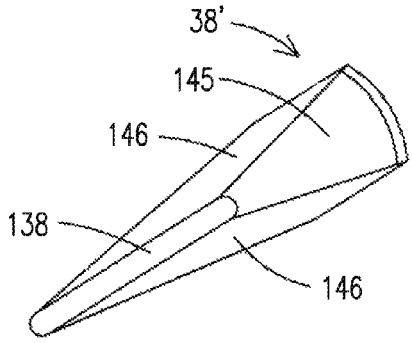
FIG. 24 is a perspective view of the standpipe with other components of the snout not present.

As shown in FIGS. 21 through 24, the standpipe 38' is tapered from the first opening 137 to the second opening 138 adjacent to the printhead 16. More specifically, the first opening 137 has a width dimension W that is larger than a width dimension \V' than the second opening 138. In addition, as shown in FIGS. 23 and 24, the standpipe 38' may include a first pair of side walls 145 within the standpipe 38' that are parallel to one another so the interior of standpipe 38' has a substantially uniform height dimension H from the first opening 137 to the second open 138. The side walls 145 may be slightly arched or bowed outward relative to an interior of the standpipe 38'. The standpipe 38' may also include a second pair of sidewalls 146 that are inclined toward each other at the second opening 138 and each have a uniform planar interior surface forming the truncated cylindrical or conical configuration shown herein. However, the tapered standpipe 38' may also have other configurations such as non-truncated cylinders or cones. FIG. 24 shows an external perspective view of the standpipe 38' apart from the snout 15' and illustrating the tapered configuration of the standpipe 38'.

In this manner, the gradually tapering standpipe 38' provides a mechanism for gas bubbles generated at or near the printhead 16 to move toward the first opening 137 and screen 37. Gas bubbles may be generated by air being ingested through the ink ejection chambers. In the case of a thermal inkjet printhead, ink is supplied via the ink reservoir through the standpipe and an ink slot to ink ejection chambers where the ink is heated to form gas bubbles to eject ink. Heating the ink may also generate gas bubbles at the printhead 16. The second opening 138 has larger height and width dimensions than the ink slot, and is preferably concentrically aligned with the ink slot. Accordingly, gas bubbles generated at the printhead can pass through the second opening 138. The tapered configuration of the standpipe 38' allows gas bubbles at the printhead 16 to travel toward the first opening 137 and the screen 37. In addition, the above-described tapered and arched configuration of the standpipe 38' eliminates sharp transitions along the interior surfaces of the standpipe 38' that may trap gas bubbles. This may be especially beneficial when the cartridge 10' may be rotated between a horizontal and vertical printing position so that in either print position gas bubbles may tend to drift or float in the standpipe 38' toward the first opening 137.

The standpipe 38' is preferably dimensioned to accumulate gas while maintaining adequate ink flow. By way of example, a standpipe 38' may be designed to have a 0.7 $cm^3$ volume that is in fluid communication with an ink reservoir 19 having a volume of 53 $cm^3$. In this example, the first opening 137 may have a width dimension of about 0.24 inches and the second opening may have a width dimension of about 0.056 inches. The height dimension H may be about 0.55 inches for both the first opening 137 and second opening 138.

The embodiment of the invention described above may be operable in a vertical or horizontal print position as previously described. That is the components making up the collapsible ink reservoir such as the basin member 20', flexible membrane 22' and moveable plate 21 have a radially symmetrical configuration. In the embodiments disclosed herein the components have a generally square configuration. In such a design configuration the fluid head pressure at the nozzles on the printhead 16 is substantially, the same when the printhead 16 is disposed in either a horizontal or vertical printing position. The fluid head pressure at the nozzles is the summation of the negative pressure generated in the ink reservoir 19' and the hydrostatic pressure of the ink against the nozzles. The hydrostatic pressure is a function of the fluid height of the ink in reservoir 19' relative to the printhead 16 or nozzles. Similarly, the characteristics and operation of the inkjet cartridges as described above with the exception of the different ink level sensing device, are the same and incorporated herein.

Ink Level Sensing System

Embodiments of the inkjet cartridge may include an ink level sensing system to monitor the volume or level of ink within the ink reservoir. With respect to FIGS. 3, 10A, 10B, 11A and 11B, the sensing system may comprise an optical position sensor 18, a detection flag 60 mounted to the moveable plate 21 and a controller 70 programmed to count ink drops ejected from the printhead 16 and nozzles. The detection flag 60 is mounted to the moveable plate 21 so as the flexible membrane 22 collapses and the moveable plate 21 moves toward the basin member 20, the detection flag 60 also moves in the same direction as plate 21.

The sensor 18 is preferably not mounted to the cartridge housing 11, but is mounted to a printing system pocket (not shown) within which the inkjet cartridge 10 is positioned for printing. When the cartridge 10 is mounted in the pocket for printing the sensor 18 is positioned adjacent apertures 74 to detect the presence of the detection flag 60 as it advances by the sensor 18. The position of the flag 60 when detected is representative of a predetermined volume of ink remaining in the reservoir.

When the sensor 18 detects the flag 60, a signal is generated and transmitted to the controller 70, which signal is representative of the predetermined volume of ink remaining in the ink reservoir 19. Embodiments of the present invention count ink droplets over a single volumetric range, which is distinguishable from those ink level sensing systems that count ink droplets over multiple ranges such as in the '039 patent and U.S. Pat. No. 6,456,802. A database or memory is available having stored data representative of a total number of ink drops that is associated with the predetermined ink volume remaining in the ink reservoir. When the controller 70 receives the signal from the sensor 18, the controller 70 begins counting the number of ink droplets ejected during various printer operations. The controller 70 may incorporate programming or software used to count ink droplets that is known to those skilled in the art. When the controller 70 has completed the ink drop counting one or more signals may be transmitted to generate an alarm or indicator that the ink reservoir 19 is empty so the cartridge can be replaced or refilled. To that end the controller 70 may be linked to a display panel that may provide a visual display of the status of the ink volume, which display may include a graphic symbol such as a gauge or an alphanumeric symbol for example.

Figure 10A:
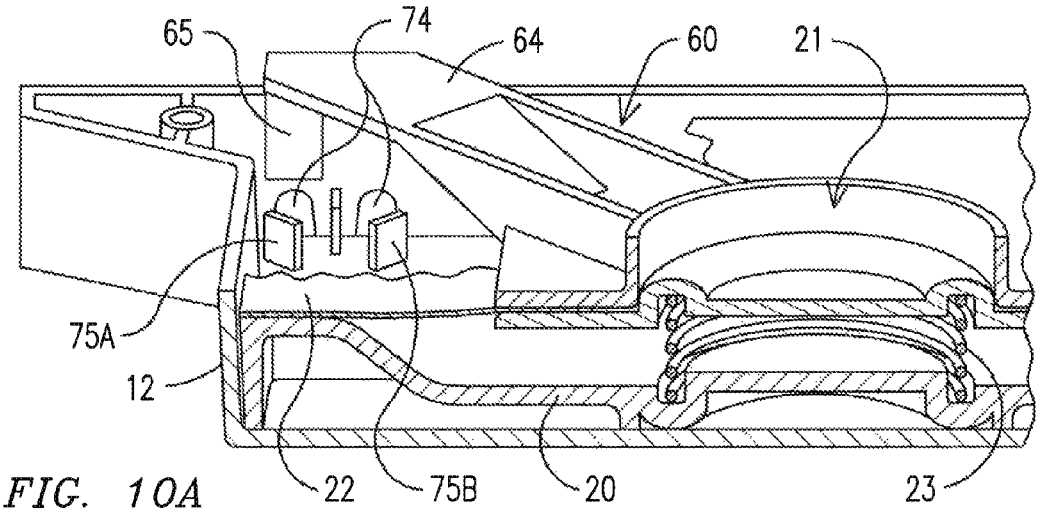
FIG. 10A is a sectional view of the cartridge with the ink reservoir shown in an expanded ink-filled position and illustrating the position of a detection flag and a sensor.
Figure 10B:
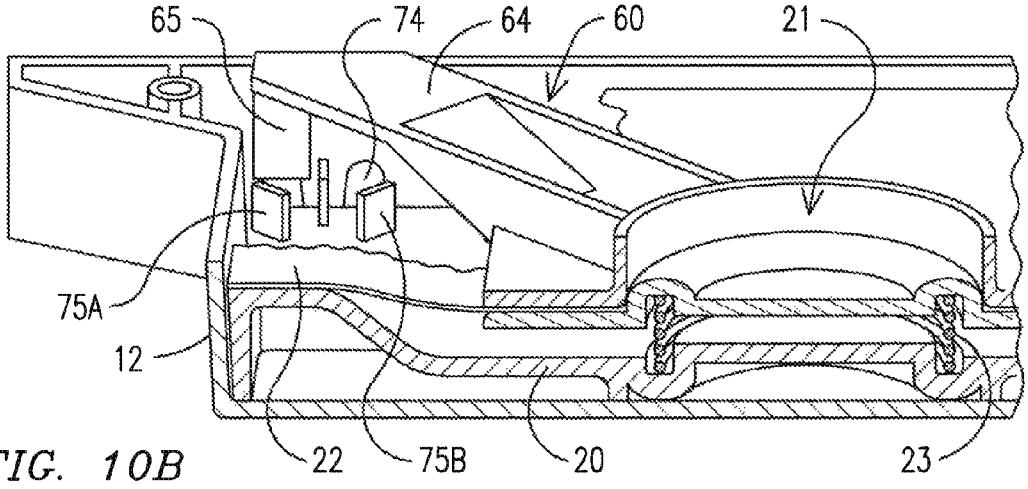
FIG. 10B is a sectional view of the cartridge with the ink reservoir collapsed and the detection flag positioned in the cartridge for detection by the sensor mounted in the housing.
Figure 11B:
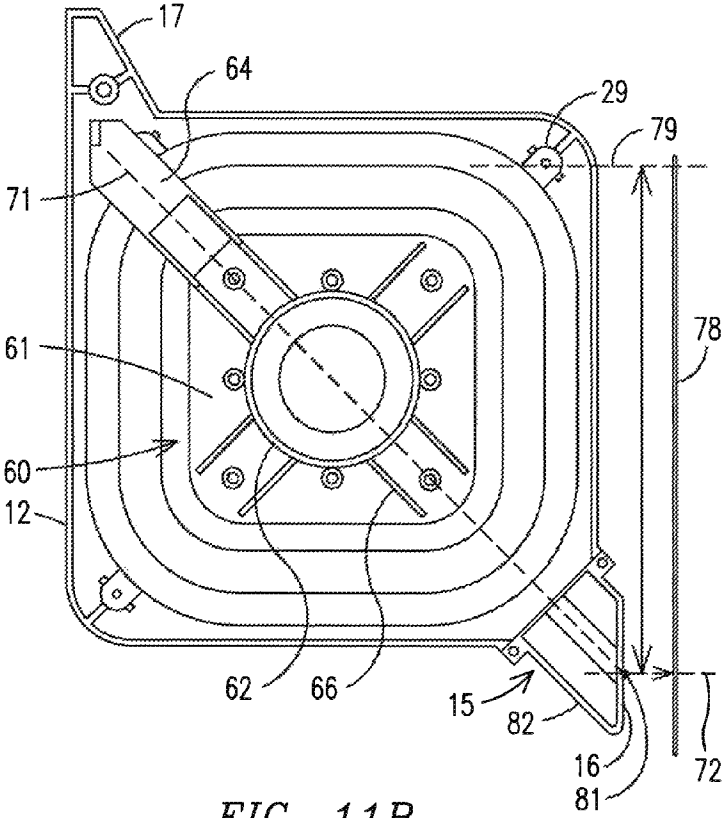
FIG. 11B is a planar view of the cartridge with a cover removed and the snout and printhead disposed in a horizontal printing position.

As illustrated in FIGS. 3, 10A and 10B, the flag 60 includes a base member 61 affixed to a surface of the moveable plate 21 exterior of the ink reservoir. The base member 61 has an outer edge 61A that is substantially coextensive with an outer edge 21A of the moveable plate 21. A ring 62 on the base member 61 is coaxially aligned with the annular protrusion 24 on the moveable plate 21 for receiving the protrusion 24. An arm 64 extends from the base member 61 toward the housing 11. A flag tip 65 depends from an end of the arm 64 distal the base member 61 and has a bottom edge 65A that is substantially coplanar with the surface of the plate 21 that faces the interior of the ink reservoir. In addition the flag tip 65 has a generally planar configuration that is disposed parallel to a surface of the printhead 16 when the printhead 16 is positioned in either a vertical printing position (FIG. 11A) or a horizontal printing position (FIG. 11B).

Figure 10C:
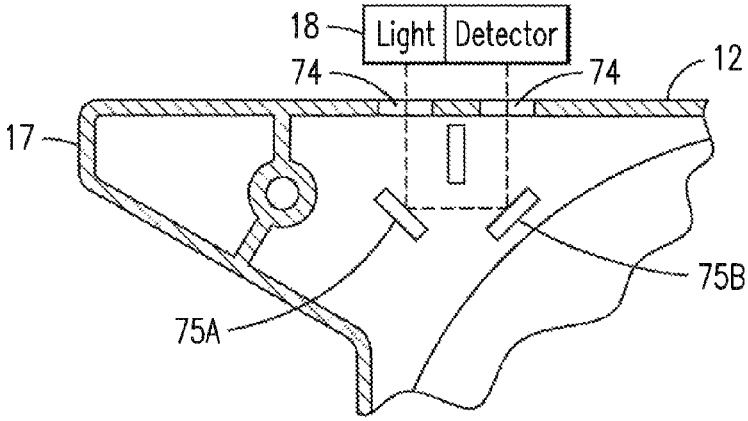
FIG. 10C is a schematic illustration of a detector in the ink level sensing system for an embodiment of the invention.

In as much as the basin member 20 is a stationary rigid component having the bowl-like configuration, the arm 64 extends obtusely relative to the basin member 20. Therefore, as the flexible membrane 22 and moveable plate 21 collapse into the basin member 20 the flag tip 65 drops between the sidewall 12 and the basin member 20 so the sensor 18 detects the flag tip 65 when the ink level drops to the predetermined volume. The sensor 18 may include a light emitting element and a light detection element. Light reflectors 75A and 75B are disposed at angles of 45° relative to the sidewall 12 to create light path (designated by dashed lines) so that light enters and exits the cartridge 10 along the path shown in FIG. 10C. The sensor 18 may be programmed such that as long as the sensor 18 detects light during printing operations no signal is transmitted to the controller 70. However, when the flag tip 65 drops between the reflective surface 75A and the sensor 18 and interrupts the light path, the sensor 18 transmits a signal 76 to the controller 70, which signal 76 is indicative of a predetermined ink volume remaining in the ink reservoir 19. At that point, the controller 70 begins the ink drop count as described above.

The components, including the base member 61, ring 62, arm 64 and flag 60 are preferably composed of a metal or sufficiently rigid plastic material such as polycarbonate, and may be integrally formed as a unitary piece. As described above, the configuration of the base member 61 is preferably coextensive with that of the plate 21, or covers a portion of the plate 21. The counter-acting forces of the negative pressure and spring 23 in the ink reservoir 19 may cause the plate 21 to bend or warp during operation. Such deformation of the plate 21 may effect the disposition of the flag tip 65 relative to the sensor 18, which may result in the sensor 18 detecting the flag tip 65 at a point that does not accurately represent the predetermined volume of ink remaining in the reservoir 19. The base member 61, including the ring 62 and ribs 66 may prevent or minimize warping or bending of the plate 21.

Figure 11A:
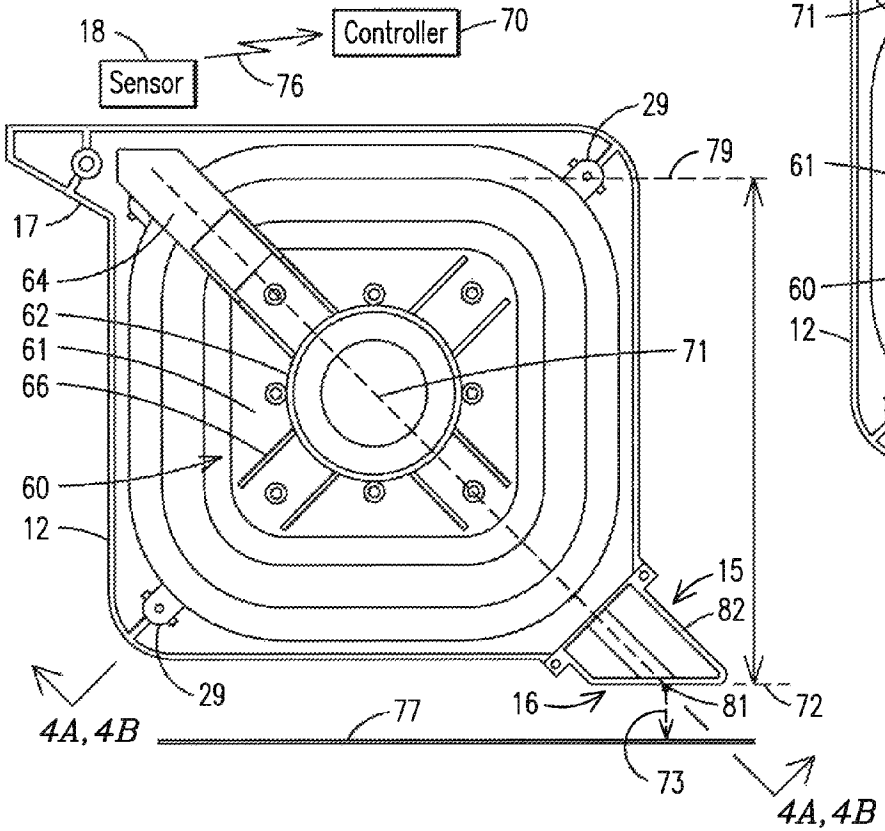
FIG. 11A is a planar view of the cartridge with a cover removed and the snout and printhead disposed in a vertical printing position.

With respect to FIG. 11A, the inkjet cartridge 10 is shown with the snout 15 and printhead 16 positioned to print in a vertical position. The dashed vertical line 73 beginning from point 81 represents the path that ink droplets may travel vertically downward toward a horizontally disposed print medium 77. In FIG. 11B, the inkjet cartridge 10 is shown with the snout 15 and printhead 16 positioned to print in a horizontal position. The dashed horizontal line 72 represents the path that ink droplets may travel horizontally toward a vertically disposed print medium 78, and dashed also happens to represent an elevation of the point 81 from which a fluid height is measured as referred to below. The detection flag 60 is connected to the plate 21 and disposed in the housing having a longitudinal axis that is disposed at an angle of about 45° to a horizontal axis and vertical axis of the cartridge when the printhead is in either horizontal or vertical printing position.

As may be appreciated in previously referenced figures the cartridge housing 11, basin member 20, flexible membrane 22 and moveable plate 22 have a generally square configuration. In such a design configuration the fluid head pressure at the nozzles on the printhead 16 is substantially the same when the printhead 16 is disposed in either a horizontal or vertical printing position. The fluid head pressure at the nozzles is the summation of the negative pressure generated in the ink reservoir 19 and the hydrostatic pressure of the ink against the nozzles. The hydrostatic pressure is a function of the fluid height of the ink in reservoir 19 relative to the printhead 16 or nozzles. In FIG. 11A the dashed line 79 represents the fluid height of ink in the reservoir measured from dashed line 72 representing the point 81, which is the center point of the nozzles on the printhead 16. The diagonal 45° line 71 represents an axis of symmetry of the ink reservoir 19 taken from the point 81, which is the center of the printhead 16 or nozzles. With respect to FIG. 11B, the cartridge 10 or ink reservoir 19 has been rotated about line 71 (the axis of symmetry) so the printhead 16 is now disposed in a horizontal printing position as represented by line 72. The fluid height in FIG. 11B of the ink in the ink reservoir 19 is represented by line 79 and measured from the point 81 which represents a center nozzle or center of the printhead 16 and referenced by the dashed line 72.

As can be appreciated from a comparison of FIGS. 11A and 11B, the fluid height of the ink in the ink reservoir 19 is the same when the printhead 16 is in either a vertical or horizontal printing position. Accordingly, the hydrostatic pressure of the ink against the nozzles will be the same in both printing orientations. Moreover, the different orientations of the cartridge 10 or ink reservoir 19 does not affect the performance of the spring 23 biasing the plate 21 away from the basing member 20, so the negative pressure is the same in either orientation. Therefore the fluid head pressure at the nozzles is the same in either the vertical or horizontal printing position. This translates into the same fluidic performance of the ink in either printing position, so ink drops are ejected through nozzles effectively and consistently in both printing positions and the cartridge 10 can print in either position. It is noted that embodiments of the invention are not limited components and the ink reservoir 19 having a generally square or rectangular shaped periphery, but may include any such shape that provide the symmetry necessary to achieve that consistent fluid head pressure at the different printing orientations.

In addition, the ink level sensing system performs consistently in either printing position. When the cartridge 10 is disposed in either the vertical or horizontal position, gravity may cause ink to slightly settle in the ink reservoir 19 toward the snout 15, printhead 16 and adjacent side of the basin member 20. The flexible membrane 22 may bulge at that general area, which may cause the flag 60 or flag tip 65 to slightly tilt. However, because the arm 64 is disposed along the diagonal line 71 (axis of symmetry) and the flag tip 65 is positioned at corner of the cartridge 10 opposite the corner where the printhead 16 is positioned, the flag tip 65 may tilt opposite the bulge in the reservoir in either printing orientation. Therefore, the ink level sensing system will act consistently in either printing orientation.

Figure 18:
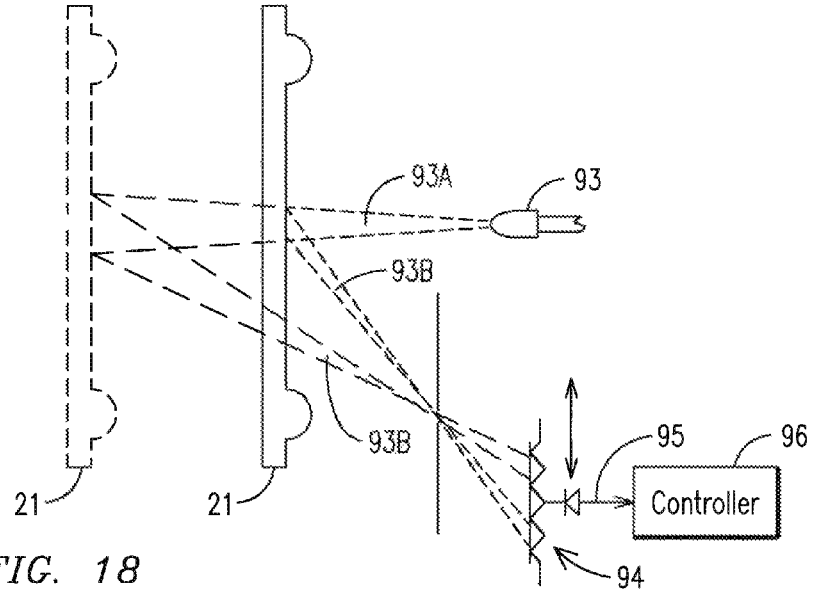
FIG. 18 is a schematic illustration of an ink level sensing system including light source and position sensing device.
Figure 19A:
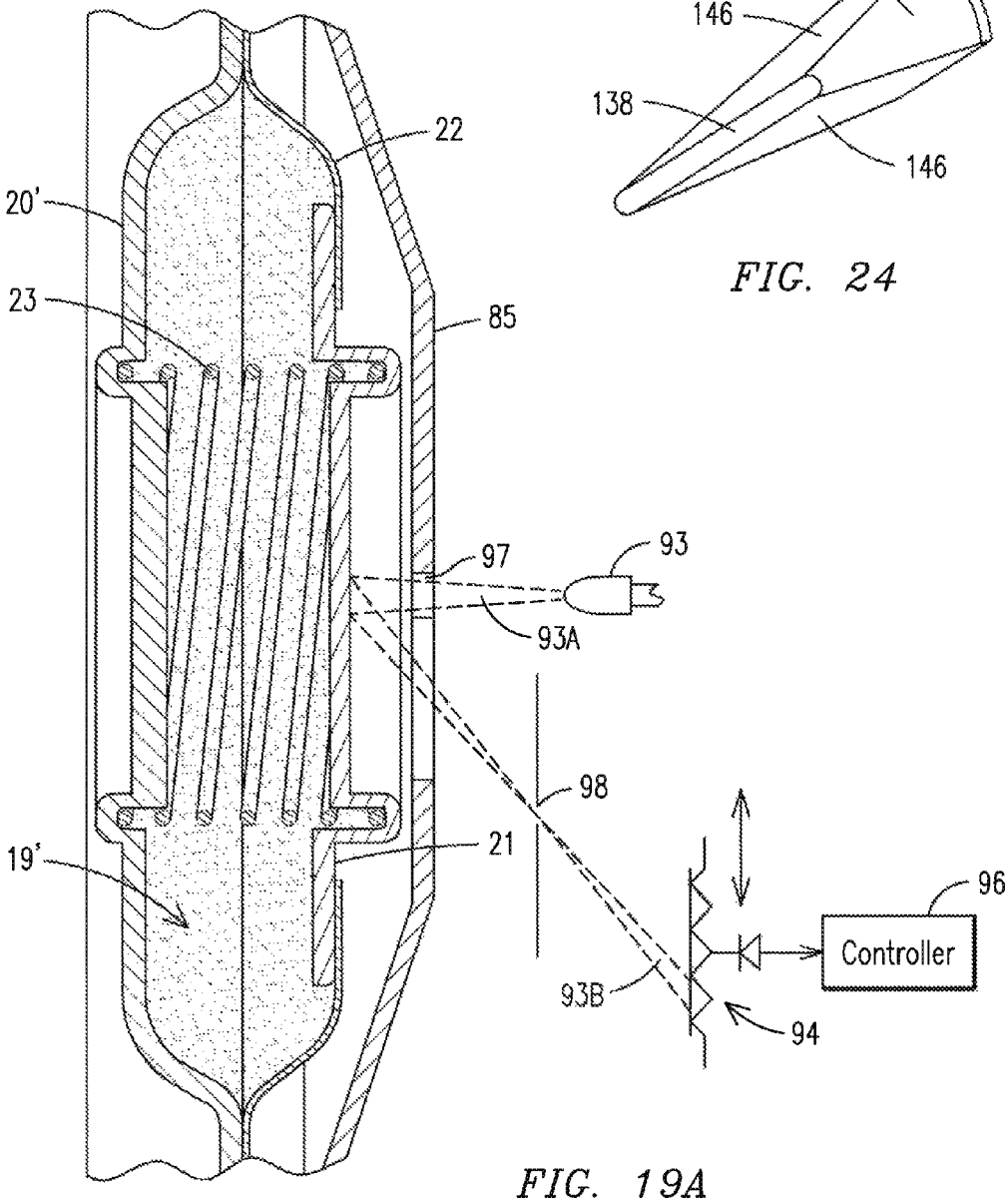
FIG. 19A is a sectional view of the third embodiment of the inkjet cartridge with a full ink reservoir and the ink level sensing system.
Figure 19B:
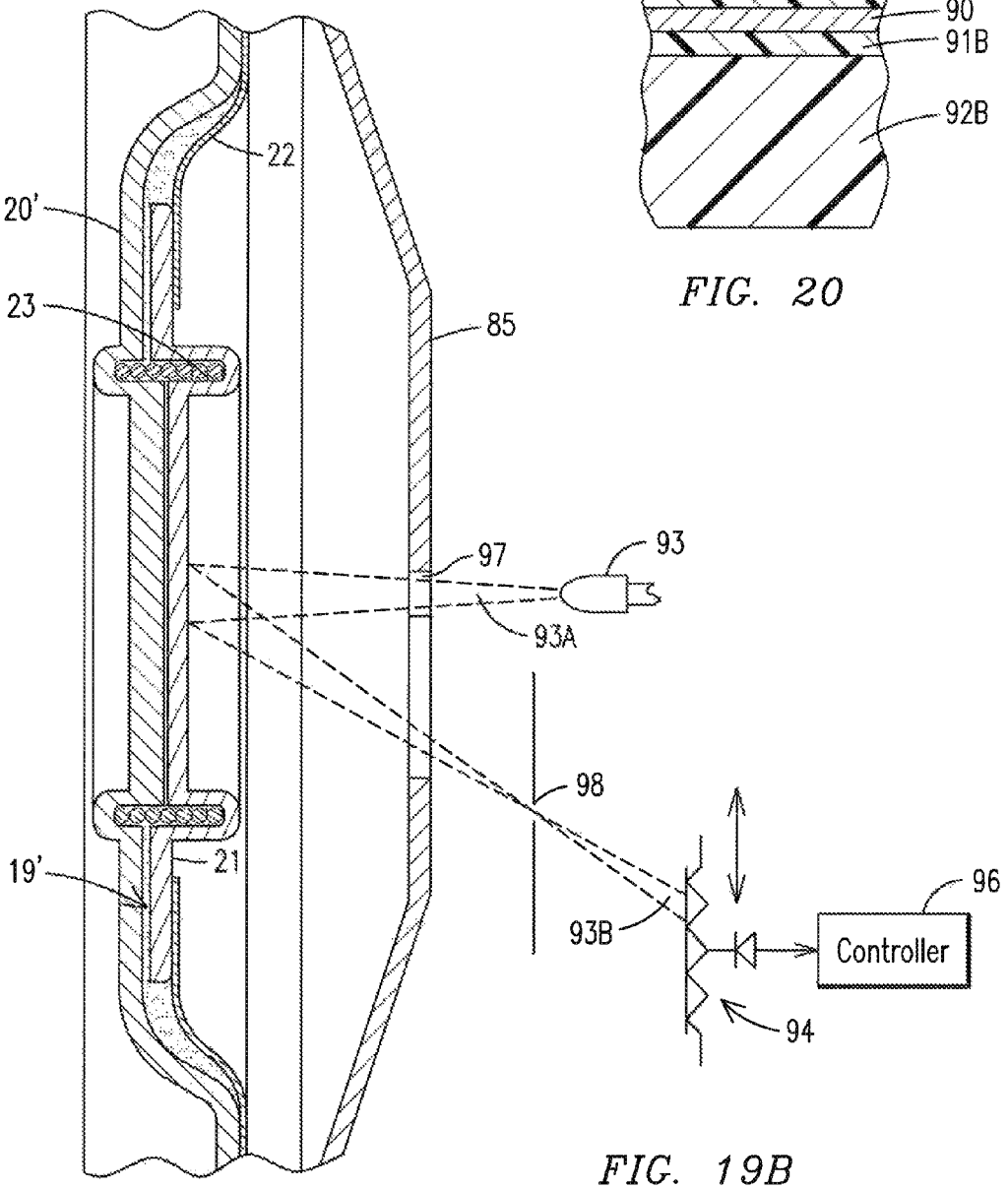
FIG. 19B is a sectional view of the third embodiment of the inkjet cartridge with an empty ink reservoir and the ink level sensing system.

Another embodiment of an ink level sensing system is schematically shown in FIGS. 18, 19A and 19B to provide a reliable method to detect a remaining amount, or volume, of ink in the ink reservoir 19'. Accurate ink level detection may be especially critical for in-line production printing wherein a cartridge's failure to print can disrupt the production process. As shown the ink level sensing system may comprise a narrow beam light emitting diode (LED) 93 that transmits a light beam 93A into the cartridge and a position sensitive device 94 (also referred to as the "PSD" or "detector") such as a photodiode that detects light reflected off the cartridge. More specifically, light is reflected off of the moveable plate 21, and a reflected light beam 93B is detected by position sensitive device 94, which transmits a signal 95 to a controller 96.

With respect to FIGS. 14, 16, 19A and 19B, the cover 85 of the cartridge 10' includes an aperture 97 at least a portion of which is positioned on the cover 85 so light from the LED 93 is transmitted onto the plate 21. The LED 93 is preferably aligned relative to the plate 21 to transmit the light onto a center of the moveable plate 21. Reflected light beam 93B is transmitted off the plate 21 through the aperture 97. The PSD 94 is aligned with the aperture 97 to detect the light beam 93 reflected off of the plate 21. There is schematically illustrated the detector 94 including an optical slit 98 that focuses the light beam 93B onto the position sensitive device 94.

In addition, as described above as a result of the radially symmetrical configuration of the ink reservoir 19' and its components, the inkjet cartridge 10' is capable of printing in either a horizontal or vertical printing position. In either position, gravity may cause the ink to settle in the ink reservoir 19' toward the snout 15', which may cause the reservoir 19' to bulge in that general area and may cause the movable plate 21 to slightly tilt away from the bulge. In the presently described embodiment the light beam 91A is preferably directed at the center of the moveable plate 21, to measure the position of the center of the plate 21. By monitoring the center of the plate 21, the ink level sing system provides consistent volume detection in both the vertical and horizontal printing position, because the center point of the plate 21 will not change in either printing position. Moreover, the center of the plate 21 does not change its position when the plate 21 tilts, so the ink level sensing system is accounting for the loss and gain in general areas of the reservoir 19' resulting from the ink settling in the ink reservoir 19'.

As described above, as ink is consumed the ink reservoir 19' will collapse. More specifically, the flexible membrane 22' collapses into the basin 20', and the moveable plate 21 moves toward the basin 20' and away from the LED 93. As the plate 21 moves away from the LED 93, the angle at which the light is reflected off the plate 21 changes. Accordingly, the point or area at which the reflected light beam 93B impacts the PSD 94 changes as the ink is consumed. The PSD 94 is provided with a signal processing circuit to generate a signal 95 indicative of the position of the reflected light 93B at the PSD 94. The signal 95 is also indicative of a position of the plate 21 and also represents a remaining ink level in the reservoir 19'. For purposes of illustrating the operation of the PSD 94 shown in FIGS. 18, 19A and 19B, the optical slit 98 has a longitudinal axis disposed normal to the page on which the illustration is drawn. In this manner, the light beam 93B is narrowed so the PSD 94 may detect different positions at which the light beam 93B is projected onto the PSD 94.

In an embodiment, the ink level sensing system disclosed herein may be a component of an inkjet printing system in which the inkjet cartridge 10 or 10' is used for printing. By way of example, the LED 93 and PSD 94 may be mounted in a pocket that holds the inkjet cartridge 10 or 10' for printing. For example, the LED 93 and PSD 94 may be mounted to the driver board 149 of the above-described pocket 106, which may include apertures through which light is transmitted. The detector 94 is linked to a controller 96 that receives signals from the PSD 94 and responds accordingly. The controller 96 may access a database that includes data relative to a remaining ink volume associated with different signals received from the detector. The printing system or controller 96 may be configured to generate any one or a plurality of signals to monitor the volume of ink in the reservoir 19'. For example, the controller 96 may be configured to display a fuel gauge-type visual display, or a plurality of different audible signals associated with different ink volumes. In addition, the controller 96 may be programmed to provide a single audible or visual signal to change the cartridge 10 or 10' for the printing system. For example, in a production line printing environment the controller 96 may generate a signal that stops a printing operation enabling one to replace the empty inkjet cartridge.

Printhead and Electrical Interconnect

Yet another novel feature of the present invention is the disposition of an electrical interconnect 82 on the snout 15 relative to the printhead 16. As shown in FIGS. 1 and 2, the printhead 16 is affixed to the snout 15 in fluid communication with the ink reservoir 19. The electrical interconnect 82 is also affixed to the snout 15 for receiving print command signals from a printing controller (not shown). The printhead 16 and electrical interconnect 82 are preferably fabricated on a single flexible substrate that is affixed to a first surface (or an ejection surface) 15A of the snout 15 with printhead 16 in fluid communication with the ink reservoir 19, and the electrical interconnect 82 is wrapped around the snout 15 and affixed to a second surface 15B of the snout 15. When the cartridge 10 is mounted in a printing system for printing the electrical interconnect 82 is aligned with and placed in contact with electrical leads from the printing system for transmitting printing commands to the printhead 16.

Figure 11C:
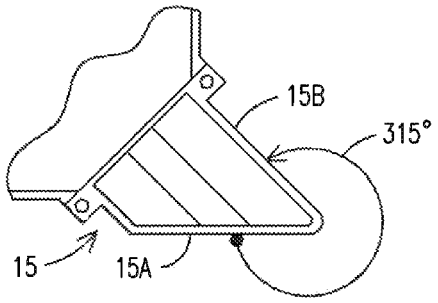
FIGS. 11C and 11D are schematic illustrations showing the interconnect surface of the snout disposed at an acute angle relative to the printhead surface.
Figure 11D:
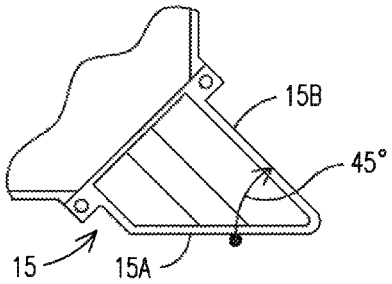

The surfaces 15A and 15B of the snout 15 are positioned relative to one another such that the electrical interconnect 82 (on second surface 15B) is disposed at an acute angle relative to the printhead 16. As shown in FIGS. 11C and 11D, in the embodiments disclosed herein, the second surface 15B is disposed at an angle that is greater than 270° to the first surface 15A in a counterclockwise direction and at an angle of less than 90° to the first surface 15A in a clockwise direction. In an embodiment, the angle of the second surface 15B relative to the first surface 15A may be about 315° in a counterclockwise direction and about 45° in a clockwise direction. Prior art cartridges have the electrical interconnect on a cartridge surface that is disposed at an angle of 90° (or 270° in a counterclockwise direction and 90° in a clockwise direction) relative to a printhead surface. At such an angle, ink ejected from a printhead may splatter when it hits a print medium, land on the electrical interconnect 82, thereby fouling or interrupting the electrical communication between the printhead 16 and a printer controller. In this described embodiment, the electrical interconnect 82 is out of range of ink splatter because it is disposed at an acute angle relative to the printhead 16.

With the cartridge 10 disposed in a horizontal printing orientation, the configuration of the snout 15, the disposition of the electrical interconnection 82 at an acute angle relative to the printhead 16 provides an advantage over prior art cartridges. More specifically, in production line printing systems one or more inkjet cartridges are positioned relative to a conveyor and a product packaging print medium for printing symbols, bar codes or other data on the medium. The cartridge is typically stationary as the packaging passes the cartridge on the conveyor, and is positioned to print an image on an end (usually a bottom end) of the packaging that is on the conveyor. Accordingly, a low deck height is desirable wherein the deck height is measured from the conveyor to a lowest nozzle on the cartridge, or nozzle closest to the conveyor. Often times however, conveyor or printing system components limit positioning of the cartridge relative to the conveyor to minimize the cartridge deck height. Embodiments of the invention in which the electrical interconnect 82 is disposed at an acute angle relative to the printhead 16 provide spacing to avoid conveyor or printing system components to minimize the cartridge deck height. In addition, the printhead 16 may be positioned closer to print medium 77 or 78 because of the disposition of the electrical interconnect 82 relative to the printhead 16; and, as described above, in this embodiment the electrical interconnect 82 is out of range of ink splatter because it is disposed at an acute angle relative to the printhead 16.

An ink level sensing system is schematically shown in FIGS. 18, 19A and 19B to provide a reliable method to detect a remaining amount, or volume, of ink in the ink reservoir 19'. Accurate ink level detection may be especially critical for in-line production printing wherein a cartridge's failure to print can disrupt the production process. As shown the ink level sensing system may comprise a narrow beam light emitting diode (LED) 93 that transmits a light beam 93A into the cartridge and a position sensitive device 94 (also referred to as the "PSD" or "detector") such as a photodiode that detects light reflected off the cartridge. More specifically, light is reflected off of the moveable plate 21, and a reflected light beam 93B is detected by position sensitive device 94, which transmits a signal 95 to a controller 96

With respect to FIGS. 14, 16, 19A and 19B, the cover 85 includes an aperture 97 at least a portion of which is positioned on the cover 85 so light from the LED 93 is transmitted onto the plate 21. The LED 93 is preferably aligned relative to the plate 21 to transmit the light onto a center of plate 21. Reflected light beam 93B is transmitted off the plate 21 through the aperture 97. The PSD 94 is aligned with the aperture 97 to detect the light beam 93 reflected off of the plate 21. There is schematically illustrated the detector 94 including an optical slit 98 that focuses the light beam 93B onto the position sensitive device 94.

In addition, as described above in paragraph 0102 through 0104 above, as a result of the symmetrical configuration of the ink reservoir 19' and its components, the inkjet cartridge 10 is capable of printing in either a horizontal or vertical printing position. In either position, gravity may cause the ink to settle in the ink reservoir 19' toward the snout 15', which may cause the reservoir 19' to bulge in that general area and may cause the movable plate 21 to slightly tilt away from the bulge. In the presently described embodiment the light beam 91A is preferably directed at the center of the moveable plate 21, to measure the position of the center of the plate 21. By monitoring the center of the plate 21, the ink level sensing system provides consistent volume detection in both the vertical and horizontal printing position, because the center point of the plate 21 will not change in either printing position. Moreover, the center of the plate 21 does not change its position when the plate 21 tilts, so the ink level sensing system is accounting for the loss and gain in general areas of the reservoir 19' resulting from the ink settling in the ink reservoir 19'.

As described above, as ink is consumed the ink reservoir 19' will collapse. More specifically, the flexible membrane 22' collapses into the basin 20', and the moveable plate 21 moves toward the basin 20' and away from the LED 93. As the plate 21 moves away from the LED 93, the angle at which the light is reflected off the plate 21 changes. Accordingly, the point or area at which the reflected light beam 93B impacts the PSD 94 changes as the ink is consumed. The PSD 94 is provided with a signal processing circuit to generate a signal 95 indicative of the position of the reflected light 93B at the PSD 94. The signal 95 is also indicative of a position of the plate 21 and also represents a remaining ink level in the reservoir 19'. For purposes of illustrating the operation of the PSD 92 shown in FIGS. 18, 19A and 19B, the optical slit 98 has a longitudinal axis disposed normal to the page on which the illustration is drawn. In this manner, the light beam 93B is narrowed so the PSD 94 may detect different positions at which the light beam 93B is projected onto the PSD 94.

In an embodiment, the ink level sensing system disclosed herein may be a component of an inkjet printing system in which the inkjet cartridge 10 is used for printing. By way of example, the LED 93 and PSD 94 may be mounted in a pocket (not shown) that holds the inkjet cartridge 10 for printing. The detector 10 is linked to a controller 96 that receives signals from the PSD 94 and responds accordingly. The controller 96 may access a database that includes data relative a remaining ink volume associated with different signals received from the detector. The printing system or controller 96 may be configured to generate any one or a plurality of signals to monitor the volume of ink in the reservoir 19'. For example, the controller 96 may be configured to display a fuel gauge-type visual display, or a plurality of different audible signals associated with different ink volumes. In addition, the controller 96 may be programmed to provide a single audible or visual signal to change the cartridge 10 for the printing system. For example, in a production line printing environment the controller 96 may generate a signal that stops a printing operation enabling one to replace the empty inkjet cartridge.

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

What is claimed is:

1. An inkjet cartridge, comprising:

a collapsible ink reservoir adapted for generating a negative pressure therein and the ink reservoir has an opening through which ink is supplied to a printhead in fluid communication with the ink reservoir;

the printhead having a plurality of nozzles in fluid communication with the ink reservoir and there being a fluid head pressure at the nozzles when the inkjet cartridge and printhead are disposed in a horizontal printing position which fluid head pressure is substantially the same as a fluid head pressure at the nozzles when the inkjet cartridge and printhead are disposed in a vertical printing position; and wherein the ink reservoir has an axis of symmetry disposed at an angle of 45 degrees relative to a surface of the printhead measured from a center point of the nozzles through the ink reservoir, and the ink reservoir can be rotated about this axis for printing in either the horizontal printing position or vertical printing position.

2. The inkjet cartridge of claim 1, wherein the inkjet cartridge comprises:

a rigid basin member;

a rigid moveable plate;

a flexible membrane having a first peripheral edge affixed to the rigid basin member and a second peripheral edge affixed to the rigid moveable plate forming the ink reservoir, wherein the flexible membrane, moveable plate and rigid basin member forming the ink reservoir;

a spring biasing mechanism disposed between the moveable plate and the inner surface of the housing for biasing the plate away from the basin member generating a negative pressure in the ink reservoir and the basin member remains stationary relative to movement of the moveable plate.

3. The inkjet cartridge of claim 2, wherein the ink reservoir has a generally square outline.

4. The inkjet cartridge of claim 2, wherein an inner surface of the basin member within the ink reservoir has a generally square outline.

5. The inkjet cartridge of claim 4, wherein the first peripheral edge of the flexible membrane has a generally square configuration.

6. The inkjet cartridge of claim 2, further comprising a housing comprising a plurality of walls affixed to one another and the ink reservoir including the basin member, moveable plate and flexible membrane are disposed within the housing.

7. The inkjet cartridge of claim 2, further comprising a cover having an outer peripheral edge affixed to the outer peripheral edge of the basin member forming a housing within which the ink reservoir is disposed.

8. An inkjet cartridge, comprising:

a cartridge housing within which a collapsible ink reservoir is disposed;

a flexible membrane affixed to an internal surface of the housing and to a rigid moveable plate forming the ink reservoir;

a spring biasing mechanism disposed between the moveable plate and the inner surface of the housing for biasing the plate away from the housing surface generating a negative pressure in the ink reservoir and the housing surface remains stationary relative to movement of the moveable plate;

a printhead having a plurality of nozzles in fluid communication with the ink reservoir and there being a fluid head pressure at the nozzles when the inkjet cartridge and printhead are disposed in a horizontal printing position which fluid head pressure is substantially the same as a fluid head pressure at the nozzles when the inkjet cartridge and printhead are disposed in a vertical printing position; and wherein the ink reservoir has an axis of symmetry disposed at an angle of 45 degrees relative to a surface of the printhead measured from a center point of the nozzles through the ink reservoir, and the ink reservoir can be rotated about this axis for printing in either the horizontal printing position or vertical printing position.

9. The inkjet cartridge of claim 8, wherein the ink reservoir is defined by a rigid basin member and the flexible membrane affixed to a surface of the rigid basin member, and wherein housing, including a plurality of connected wails, within which the basin member and flexible membrane are disposed, and the rigid basin member and flexible membrane each has a generally square configuration.

10. The inkjet cartridge of claim 8, wherein the rigid basin member and a cover plate positioned over the flexible membrane and affixed to the rigid basin member define the housing, and the rigid basin member and flexible membrane each has a generally square configuration.

* * * * *